United States Patent [19]

Eisermann

[11] Patent Number: 4,964,494

[45] Date of Patent: Oct. 23, 1990

[54] LOCKING DEVICE CONSISTING OF A BOLT LOCK AND KEY-ACTUATED LOCK CYLINDER

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 344,272

[22] Filed: Apr. 27, 1989

[30] Foreign Application Priority Data

May 7, 1988 [DE] Fed. Rep. of Germany ..... 3815716
May 7, 1988 [DE] Fed. Rep. of Germany ..... 3815715
May 7, 1988 [DE] Fed. Rep. of Germany ..... 3815714

[51] Int. Cl.[5] ..... G07F 17/12
[52] U.S. Cl. ..... 194/253; 70/369
[58] Field of Search ..... 194/253, 257; 70/367, 70/368, 369, 371, 421, DIG. 41

[56] References Cited

U.S. PATENT DOCUMENTS 1,986,676 1/1935 Hurd ..... 70/369 X
2,011,003 8/1935 Liss ..... 70/369
2,145,085 1/1939 Heyer ..... 70/421
3,621,965 11/1971 Eicken ..... 194/253
4,572,348 2/1986 Eisermann et al. ..... 70/DIG. 41

FOREIGN PATENT DOCUMENTS 310610 10/1973 Austria .
2839421 3/1980 Fed. Rep. of Germany ..... 194/253

*Primary Examiner*—F. J. Bartuska
*Attorney, Agent, or Firm*—Martin A. Farber

[57] ABSTRACT

A locking device consisting of a lock and a key-actuated lock cylinder, in which the lock cylinder can be removed from the bolt lock only by the use of a key. In order to make it possible for any removal of the lock cylinder to be noted, the invention discloses a separate removal key and a catch which drops upon the removal and prevents re-insertion of the lock cylinder.

28 Claims, 21 Drawing Sheets

1a
11a
12a
16a
9a
10a
8a
2a
3a
44a
42a
43a
6a
81a 2a
1a
16a
14a
17a
25a
11a
30a
12a
18a
43a

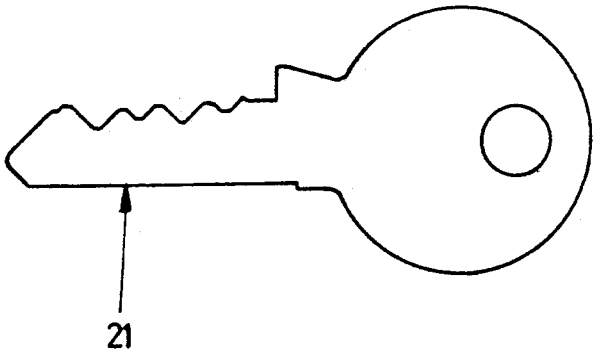
FIG. 8
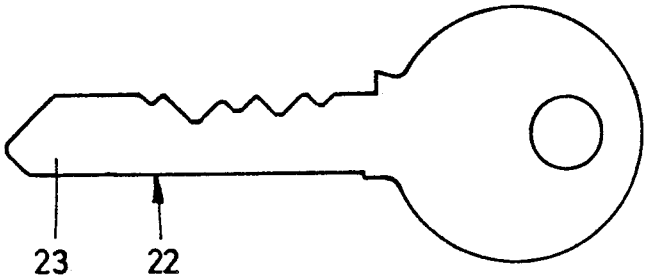
FIG. 9
FIG. 10'
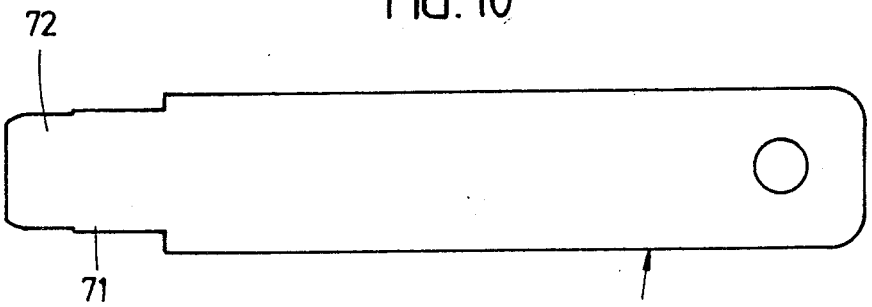
FIG. 10"
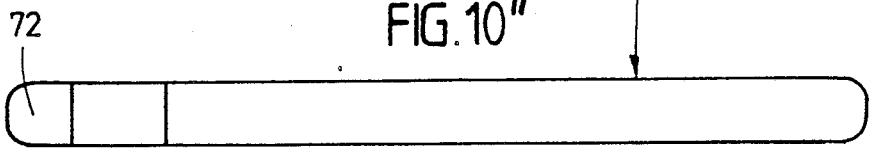

FIG. 15a
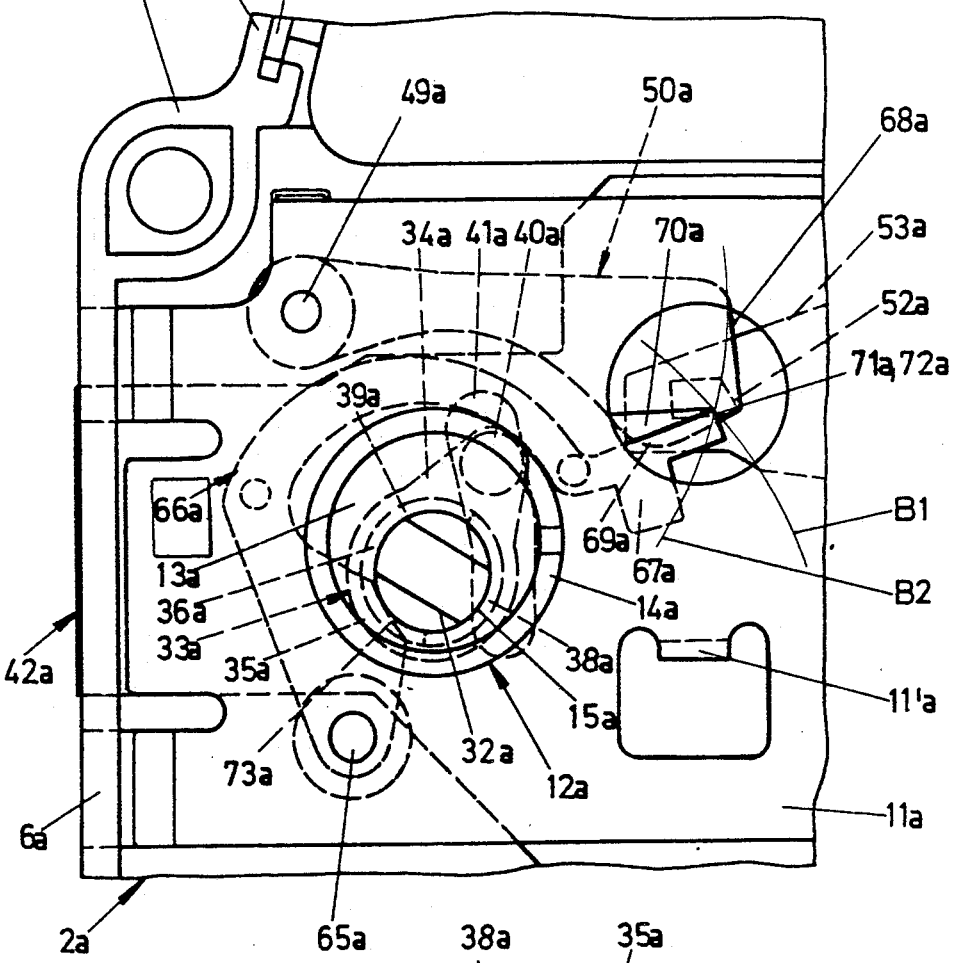
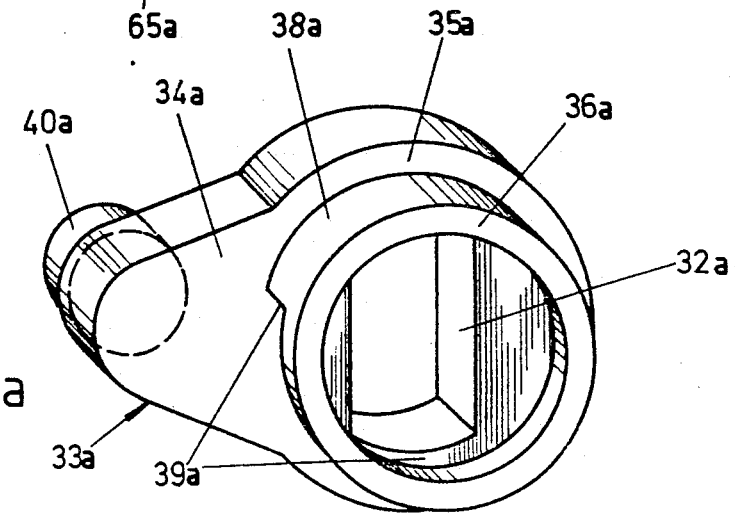
FIG. 16a

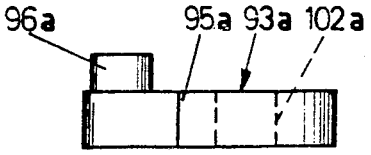
Fig.17a
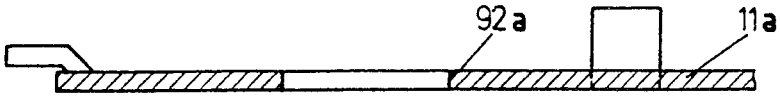
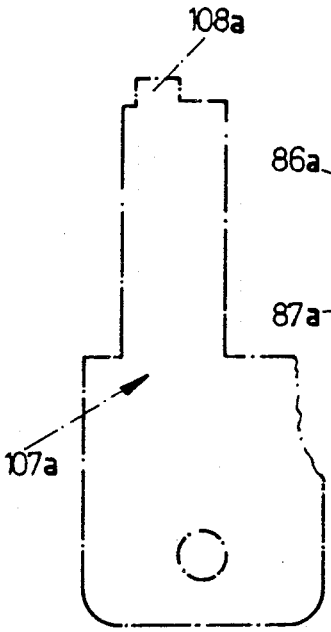
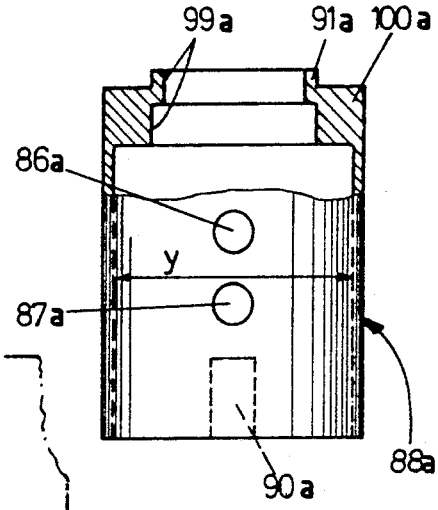
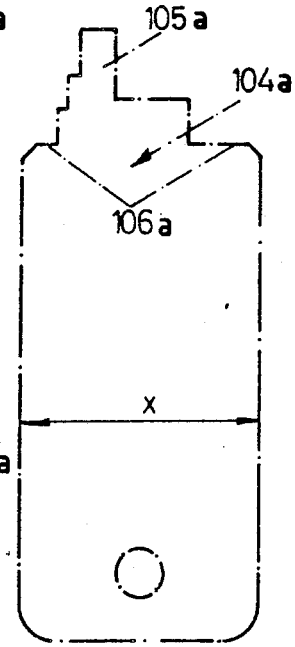
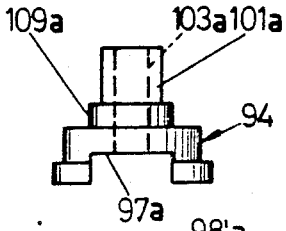
Fig. 19a
Fig. 18a
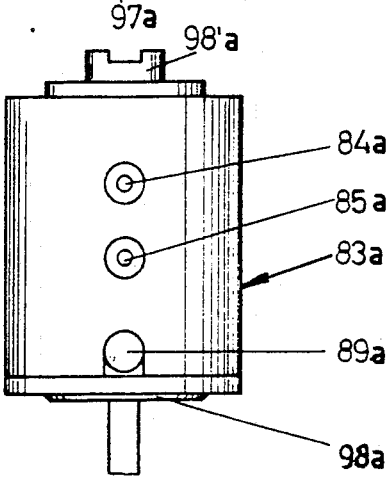

LOCKING DEVICE CONSISTING OF A BOLT LOCK AND KEY-ACTUATED LOCK CYLINDER

FIELD AND BACKGROUND OF THE INVENTION

The present invention relates to a locking device consisting of a bolt lock and key-actuated lock cylinder (18 or 77) in which the lock cylinder including a locking member (29 or 82) thereof is in coupling engagement with a bolt-actuation device, and can be removed from a bolt lock only by use of a key.

Such a locking device which is suitable for use on doors of lockers, is known from Austrian Patent No. 310 610. The bolt lock is fastened on the inside of the door while the lock cylinder passes through the door and can be actuated by a key which can be inserted from outside the door. When the bolt is in its retracted position, the key cannot be removed. It can be removed only after completion of the forward closing movement, which requires the insertion of a coin. If the user of the locker then loses the key, the locking device can be opened by a master key which is in the possession of a supervisor. If such a master key, however, comes into unauthorized hands, corresponding lockers can be opened and then closed again without leaving any trace. It is therefore difficult for the user of a locker to prove that he has been robbed. Also in the case of other locks the problem frequently arises that it is not possible to verify whether a lock cylinder has been actuated by a given key. If due to his absence, the owner of a house, for instance, turns over his key to a person to whom he allows access in case of an emergency, then he cannot determine after his return whether the key was actually used or not.

SUMMARY OF THE INVENTION

It is the object of the subject matter of the present invention so to develop a locking device of this type in such a way and in a manner simple to manufacture that there is at least one key which permits the opening, but which opening always leaves a trace.

In a locking device of the type described, this object is achieved by the features wherein removal of the bolt lock by use of a key is accomplished by a separate removal key (22, 79) and a catch which drops upon removal and prevents re-insertion of the lock cylinder.

The ensuing description and the claims present further advantageous developments.

As a result of this development a locking device of the type described is created which provides increased security. The locking device can be actuated in the customary manner by means of the normal key. But should this key, for instance, be lost then the removal key can be used. After its insertion into the key channel of the cylinder core, the core can be shifted, for instance, only through a limited angle of rotation. The bolt does not yet then pass into its release position. The turning of the removal key through the limited angle of rotation, however, permits removal of the lock cylinder. The opening of the locking device is thereupon possible. After the removal, however, the lock cylinder can no longer be inserted by means of this removal key and the door can thus no longer be locked. It is therefore necessary to install a new lock cylinder by means of a normal key.

If the aforementioned process was carried out by means of a removal key in the hands of unauthorized persons, then the lock cylinder can no longer be installed again with the removal key once the door has been opened since, as a result of the limited angle of rotation, the locking member cannot be coupled to the bolt actuation opening either in the opening or in the closing position of the bolt. There therefore remain traces which indicate the unauthorized opening of the locking device. This may be of importance also for insurance reasons. If a burglar should, for instance, install another lock cylinder after opening the door, then the rightful user of the key will not be able to open this lock cylinder with his key. There is therefore present in all cases a control function which is distributed over several persons.

The removal key can, for instance, be given to someone else for use in an emergency and one will later on know for certain whether it was used or not. One such development consists advantageously of the fact that upon the use of the removal key, after it has passed through the limited angle of rotation, it releases an interlock of the lock cylinder with its holding bushing. Only then is removal of the lock cylinder possible.

One embodiment is characterized by a finger which is swingable, as a function of the movement of the bolt, in front of the bolt-actuation opening and blocks the latter. If the lock cylinder was removed by means of a removal key, and the bolt was then moved into the backward closing position via the bolt-actuation opening by means of a tool, then subsequent installation of the lock cylinder is not possible since its locking member finds the bolt-actuation opening in an incorrect position. If forward locking of the bolt takes place by means of the special tool, then an aligned position of the two can, to be sure, be obtained. However, the swingable finger then enters into action, and entirely or partially blocks the boltactuation opening.

In another variant, it is possible to provide a passage opening which is adapted to the locking member and arranged in the lock cover of a mortise lock. In this case a removal key must be inserted with which it is possible to turn the locking member from the position which corresponds to the key-insertion position into a position which is aligned with the passage opening. Therefore, when the removal key has displaced the locking member by the limited angle of rotation, the lock cylinder can be removed. A passage-blocking finger, however, then enters into the region of the passage opening and prevents subsequent installation of the lock cylinder, this condition of the locking device thus indicating that the lock cylinder was removed. The passage-blocking finger can be brought into the unblocking position only by using the proper key, which then takes the place of the removal key.

Another aspect of the invention employs installation of a completely new lock cylinder with a normal key.

The passage-blocking finger is a simple structural element which can readily be integrated into the construction of a lock. Upon actuation by the normal key, the passage-blocking finger is displaced against spring load as a result of the run-on flanks provided on it. It has proven particularly economical to develop the passage-blocking finger as a spring. In the first embodiment of the locking device, the measure is taken that after removal of the lock cylinder, and with the bolt in partially backwardly closed position, the bolt returns into the open position due to spring action, so that mounting of the lock cylinder is fundamentally not possible since its locking member finds the bolt-actuation opening in turned position. The subsequent advancing of the bolt then leads to the displacement of the blocking finger. In order to permit it to come into a locking-member passage cross-section, the hub of the bolt driver is provided with the radial slot. In order to permit movement of the locking member past the finger after passage through the limited angle of rotation, the locking member has been provided with corresponding run-on bevels, one of which raises the blocking finger into a release position.

BRIEF DESCRIPTION OF THE DRAWINGS

The two first embodiments of the invention will be explained below with reference to FIGS. 1 to 24, of which:

FIG. 8 is a view of the corresponding key, FIG. 9 is a view of a removal key which has a longer shank than the normal key, FIG. 10 is a view of an auxiliary key, FIG. 10" is a top view of the auxiliary key.

Three further embodiments of the invention will be explained below with reference to FIGS. 1*a* to 22*a* of which FIG. 15*a* shows the following position in which, after the complete retraction of the bolt, the bolt keeper is held in the raised position by the swivel arm, FIG. 16*a* is a perspective view of the disk used in this embodiment and developed as hub, FIG. 17*a* is an exploded view of the second embodiment, FIG. 18*a* is a view of the auxiliary key used in the latter, shown in dash-dot line, FIG. 19*a* shows the corresponding tool key, also in dash-dot line.

DETAILED DESCRIPTION OF THE PREFERRED EMBODIMENTS

Figure 2:
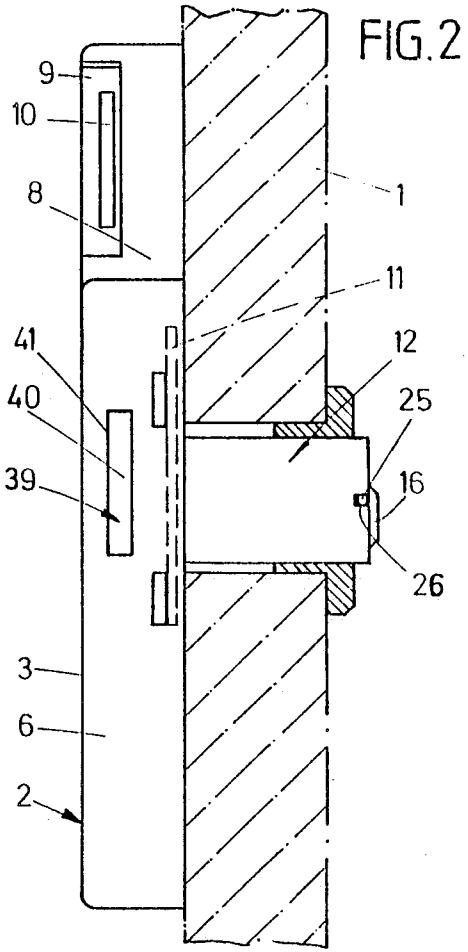
FIG. 2 is a side view of the locking device.
Figure 1:
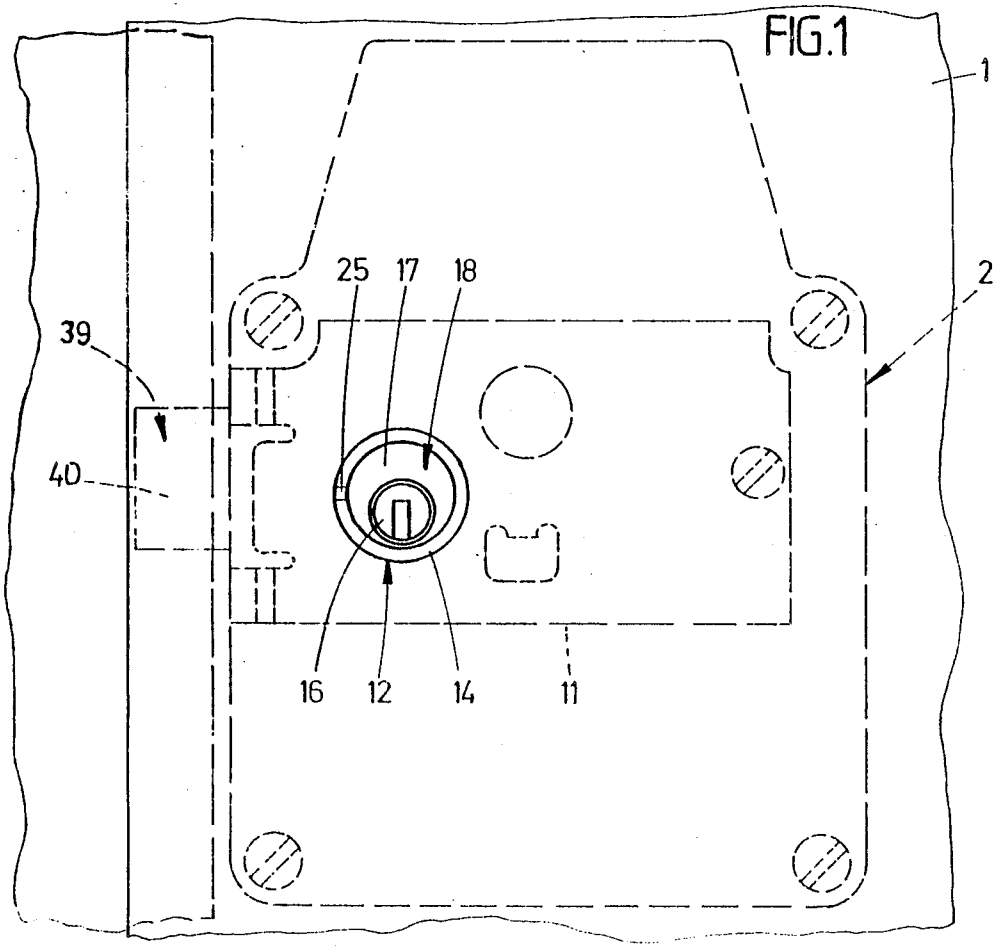
FIG. 1 is a front view of a locker door having the locking device of the first embodiment attached on its inner side and with the bolt advanced.

The locking device according to the first embodiment, shown in FIGS. 1 to 16, has a bolt lock 2 which is attached on the inner side of a locker door 1 of a public swimming establishment, the lock case of this bolt lock having a lock bottom 3, and, bent off from the latter, lock-case sidewalls 4, 5, 6 and 7. The upper lock-case sidewall 7 continues into a hood which has a slide 9 with calibrated coin insertion slot 10 on its one, obliquely extending sidewall 8.

The lock ward is covered by a lock cover 11. The latter bears a holding bushing 12. For the fixing in position of the latter, screws S are provided which are screwed in from inside the lock cover 11 and engage into the bottom region 13 of the holding bushing 12. The bottom region 13 is provided with a bearing opening 15 which extends eccentrically to the bushing wall 14 and through which the cylinder core 16 of a lock cylinder 18 mounted in the cylinder housing 17 passes. In installed position, the end surface of the lock cylinder is flush with the outer end wall of the holding bushing 12.

Figure 9A:
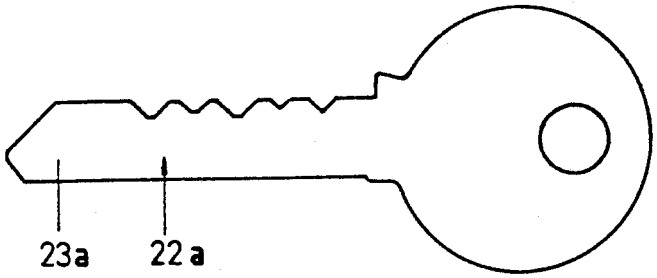
FIG. 9*a* is a view of a special key which has a longer shaft than the individual key.
Figure 11A:
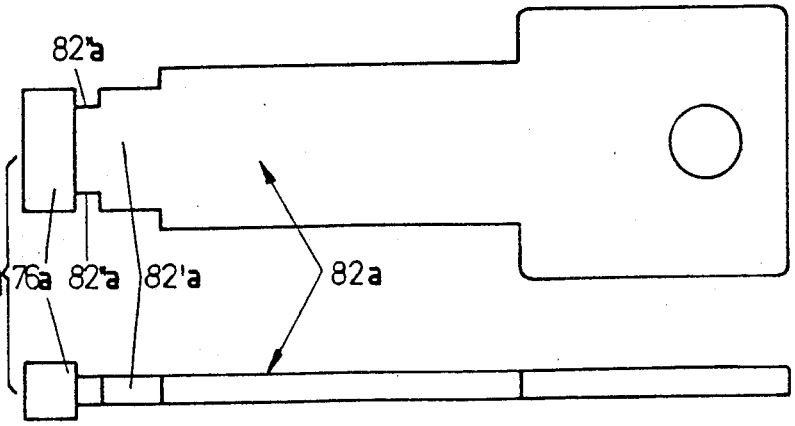
FIG. 11*a* is a front view and top view of a tool key which permits the advancing of the bolt only by means of a coin.
Figure 11:
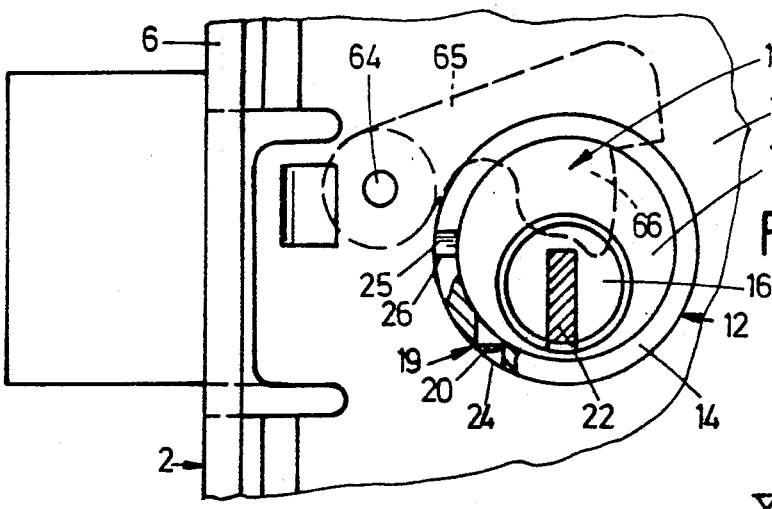
FIG. 11 is a view of the lock cylinder seated in a holding bushing, shown broken away in the region of the detent and with the removal key inserted.
Figure 13:
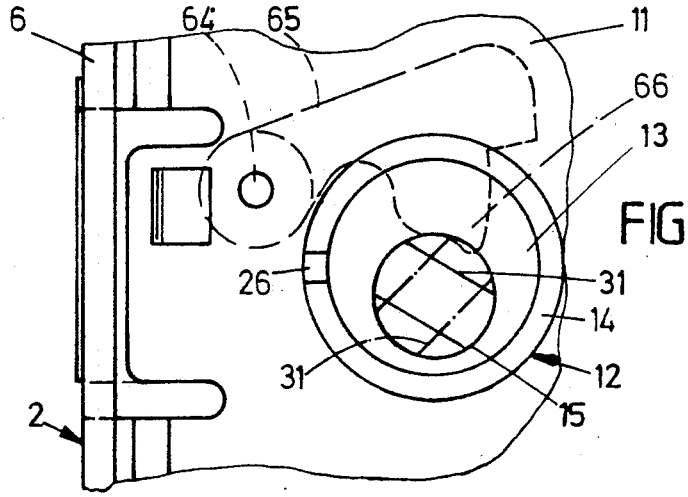
FIG. 13 is a following view, the lock cylinder having been removed from the holding bushing.

The lock cylinder 18 is secured against turning and withdrawal in the holding bushing 12 by a detent 19. The latter is a detent pin 20 which is guided in secant-like alignment in the cylinder housing 17, and is urged outwards by spring action, located on the inner end of the lock cylinder 18, a region thereof (not shown) extending into the cylinder core 16. In its inserted position shown in FIG. 7, a normal key 21, which is shown in FIG. 8 and corresponds to the lock cylinder 18, cannot reach the detent pin 20. This is possible only by means of a removal key 22 which is shown in FIG. 9 and which has a longer key shank than the key 21. The tip 23 of the inserted removal key 22 namely extends up to the detent 19. In the key-removal position of the lock cylinder 18, the position shown in FIG. 11 is present, in which the detent pin 20 is in engagement with a detent opening 24 in the bushing wall 14. This position is additionally secured by a radial pin 25 which is fastened in the front-side region of the cylinder housing 17 and extends into an edge-side open groove 26 of the bushing wall 14.

The extension 27 of the cylinder core 16 which protrudes beyond the inner end of the lock cylinder 18 is provided with a circumferential groove 28 located on the inner side of the lock case, the circumferential groove being adjoined by a locking member 29 obtained by a flattening on both sides. The key channel 30 of the cylinder core 16 continues into the locking member 29. The latter engages into a depression 31 of corresponding cross section in a bolt driver 32. The latter has a hub 33 which engages in a bearing bore hole 34 of the lock cover 11 and extends up to the bottom region 13 of the holding bushing 12. The hub 33 has, on the inside of the lock case, a radial slot 35 which extends transverse to the longitudinal axis of the lock cylinder. The radial slot is developed as a partial annular groove which is at the height of the circumferential groove 28. A strong plastic has been selected as material for the bolt driver 32 and the hub 33.

The bolt driver 32 forms a control arm 36 which is equipped with a coupling pin 37 directed toward the inside of the lock. The coupling pin engages into a transverse slot 38 in a bolt 39 guided in the bolt lock 2. The bolt head 40 of the bolt passes through a cross-sectionally adapted opening 41 in the sidewall 6 of the lock case and cooperates with a closure plate (not shown) of the locker on the side of the fixed frame. For the further guidance of the bolt 39 there is provided in the bolt tail 42 a slot 43 which is open on its edge side, extends in the opening direction and into which a square pin 44 on the bottom-side of the lock engages. The bolt tail 42 bears a torsion spring 45 which urges the bolt 39 in the direction toward the inside of the lock, i.e. in opening direction.

A bolt keeper 47 which is developed as a one-arm lever is mounted above the bolt head 39 around a supporting pin 46 on the bottom-side of the lock. The bolt keeper is urged by a spring 48 in clockwise direction. A blocking finger 49, which reaches to the bottom 3 of the lock, extends from the broad side of the bolt keeper 47 which faces the bolt tail 42, the blocking finger passing through a shaped cutout 50 in the bolt tail 42. The cutout 50 is provided with blocking edges 51, 52 extending transversely to the direction of locking of the bolt. With the bolt 39 retracted, the blocking finger 49 rests in the front region of the cutout 50 on the lower edge thereof, see FIG. 3.

Figure 3:
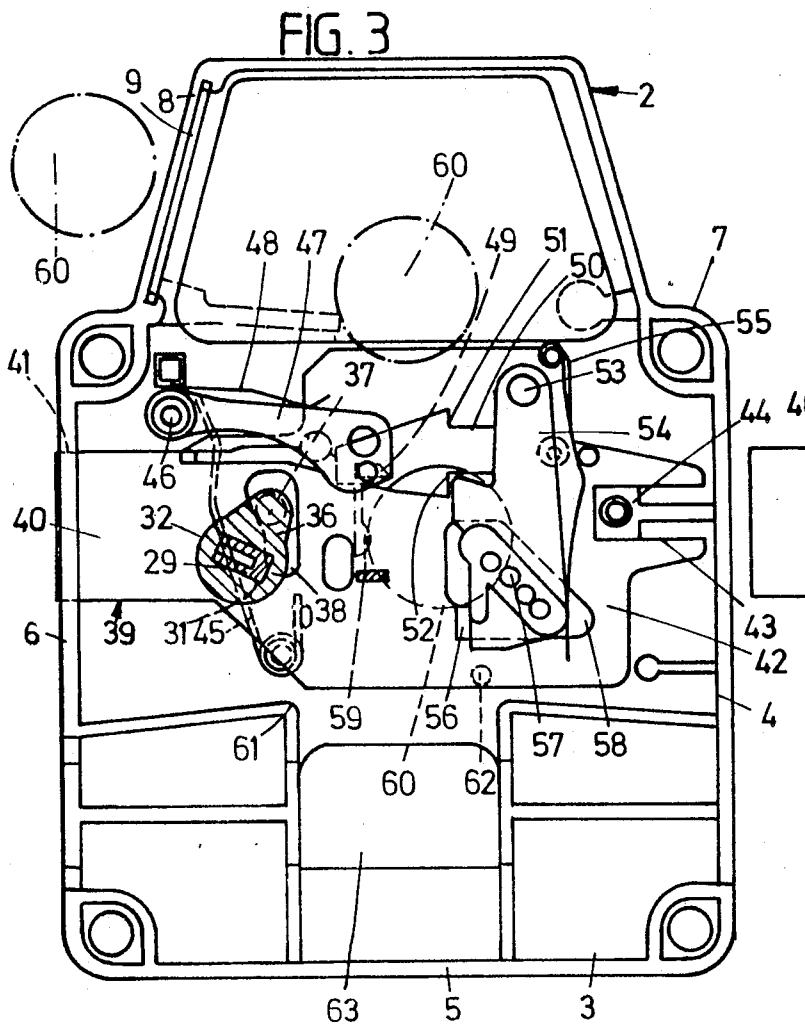
FIG. 3 is a rear view of the bolt lock developed as coin lock, with the bolt retracted and the lock cover removed.
Figure 4A:
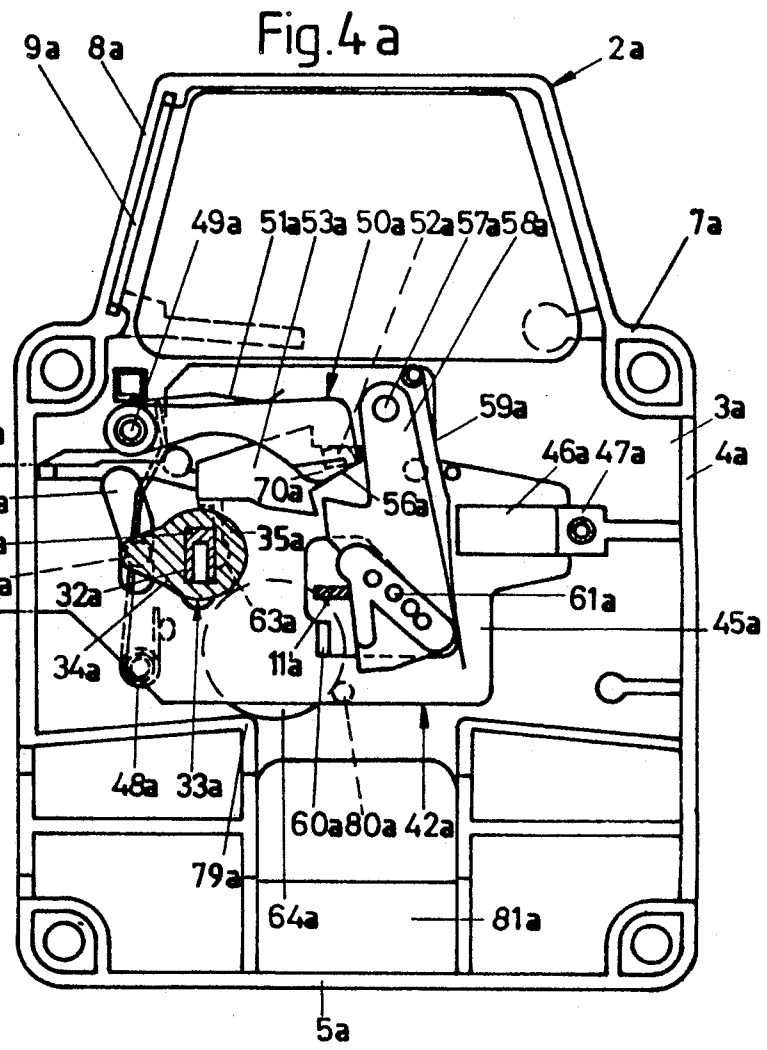
FIG. 4*a* is a showing corresponding to FIG. 3*a*, the bolt being in this case advanced.

In the upper rear region of the bolt tail, a one-armed rocker arm 54 which is urged in clockwise direction by a leaf spring 55 is mounted around a pin 53 on the bolt-tail side. On the bolt-tail side a projection 56 against which the lower end of the rocker arm 54 rests serves to limit the swinging motion of the rocker arm 54. The lower end of the rocker arm bears a support pin 57 which passes through a cutout 58 in the bolt tail 42 and extends up to the bottom 3 of the lock. The support pin 57, cooperates with a support shoulder 59 on the bolt side. The distance between the latter and the support pin 57 is smaller than the diameter of a coin 60 inserted into the coin slot 10 so that the coin, as shown in FIG. 3, is held by the support shoulder 59 and the support pin 57 only after its insertion.

The insertion of a coin 60 is possible when the door of the locker is open. The key 21 is then also inserted in the lock. The locking rotation can now be effected, the carrying along of the bolt 39 in the locking direction taking place in this case via the control arm 36 of the bolt driver 32. Together with the pre-locking movement the coin 60 is also carried along, its edge acting on the blocking projection 49 and thus raising the bolt keeper 47 into such a position that the blocking projection 49 is not disturbingly in the way of the blocking edges 51, 52 of the bolt tail 42. The bolt 39 can, in this way, be completely advanced into the position shown in FIG. 4 in which the individual key 21 can be pulled out of the lock cylinder 18. During the pre-locking, the rocker arm 54 strikes against a bend 11' in the cover 11 of the lock, is swung as a result, thereof and releases the coin 60 for dropping down, it then being held in an intermediate position by a shoulder 61 on the housing side and a support pin 62 of the bolt 39. Upon the retraction of the bolt 39, the coin 60 passes into a coin-return compartment 63, so that the bolt lock accordingly operates in accordance with the deposit principle.

The lock cover 11 is mounted in the region of the bolt head 40 of the retracted bolt 39 around a peg 64 of a swivel arm 65 which forms a finger 66 pointing in the direction of the lock cylinder. This finger passes through the radial slot 35 of the hub 33 of the bolt driver 32 and engages into the circumferential groove 28. When the bolt is retracted, the finger 66 still rests against the connection web 67 of the hub 33, which limits the insertion of the finger 66. In this position, the upper end 68 of the swivel arm 65 is below the arcuate edge 69 of the bolt keeper 47.

Figure 10A:
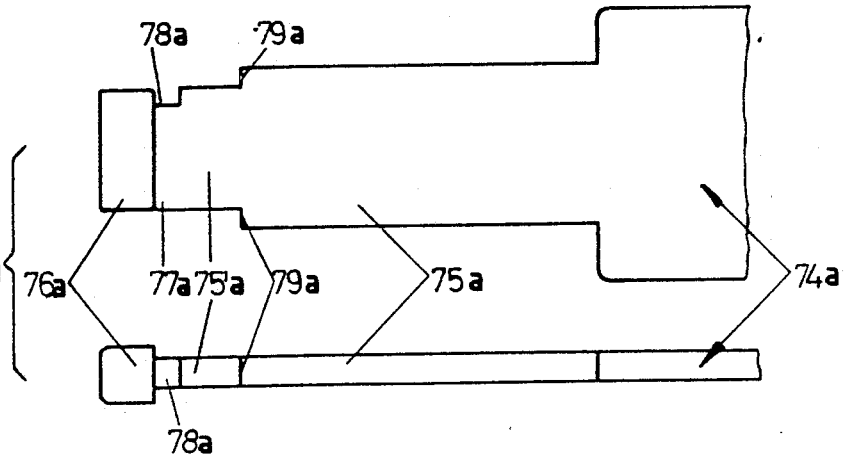
FIG. 10*a* is a front view and top view of the auxiliary key.

When the lock cylinder 18 is not inserted, the bolt lock can be actuated by means of an auxiliary key 70 according to FIGS. 10' and 10''. The shank 71 thereof bears at its end a stepped guide extension 72 the cross-section of which is adapted to that of the recess 31 in the bolt driver 32. It is possible by means of this auxiliary key 70 to advance the bolt 39 without the insertion of a coin. If the auxiliary key 70 is inserted with the bolt retracted then the narrow edge of the shank 71 acts upon the advancing motion on the finger 66 and raises the latter, with the simultaneous carrying along of the bolt keeper 47 in such a manner that the blocking projection 49 thereof does not impede the advancing of the bolt 39. In the advanced position, the finger drops into the position shown in FIG. 14 and thus extends within the region of the locking-member passage cross-section.

The returning of the bolt 39 from the advanced position is also possible by means of the auxiliary key 70. In an intermediate phase of the locking rotation, the corresponding narrow edge of the key shank 71 acts on the finger 66.

For the use of the lockers, the corresponding lock cylinders 18 must then be installed in the holding bushing 12.

If the user of a locker does not return the individual key 21 and the bolt 39 is advanced, it is then possible to remove the lock cylinder 18 by means of the removal key 22, namely after turning the cylinder core 16 backward through the limited angle of rotation within which the detent 19 is eliminated. If the lock cylinder 18 is now pulled out, then the one run-on bevel 73 of the locking member 29 acts on the finger 66 and raises it, which permits ready removal of the cylinder 18. After removal of the latter, the torsion spring 45 enters into action and displaces the bolt 39 into its open position together with a turning of the bolt driver 32 as a result of coupling engagement between the latter and the bolt 39. The lock cylinder 18 can then no longer be inserted into the holding bushing 12 by means of the removal key 22 since the locking member 29 encounters the recess 31 in the bolt driver 32 in an angularly twisted arrangement. Therefore, a corresponding individual key or a new lock cylinder must be obtained.

The above facts make it impossible to open the locker and close it again without leaving any traces with a removal key 22 which has been copied without authorization. To be sure, opening is possible; but the lock cylinder 18 can then no longer be inserted. If it is attempted, for instance, to advance the bolt by means of a screwdriver, then the finger 66 drops in the advanced position of the bolt 39 into the locking member cross-section and also prevents insertion of the lock cylinder by means of the removal key.

The inventive concept can be extended to the creating of a general key which can be used both as removal key and as insertion key and which, with respect to the locking, may also retain a master key function with due consideration of the function of the payment of a fine. This means that in such a case opening and locking can be effected with the general key without the insertion of a coin and with removal of the deposit coin stored by the lock.

This general key could differ from the removal key in that it has a cutout in its key shank which is extended as compared with the individual key, the cutout cooperating with a rotation-limiting pin of the lock cylinder.

This general key could furthermore be so developed that for the insertion of the lock cylinder it pulls back the detent.

In accordance with the second embodiment, shown in FIGS. 17 to 24, the locking device has a bolt lock 74, shown in section, with a bolt 91 guided therein. The lock cover 75 of the bolt lock 74 bears a holding bushing 76, the inner contour of which is adapted to that of a profiled lock cylinder 77. In this embodiment, the lock cylinder 77 is developed as semi-cylinder. It can be locked by a normal key 78 and a removal key 79, the shank of the latter being made longer than that of the key 78. Furthermore, between the holding bushing 76 and the lock cylinder 77 there is also provided a detent 80 which can be overcome solely by the longer removal key 79 in the manner that the extended tip 81 of the latter eliminates the detent 80, namely after passing through an angle of rotation which is less than 90° . When using the removal key 79, the latter forms stops which limit the angle of rotation of the cylinder core 83. However, with the normal key 78 the cylinder core can be turned unimpeded in both directions.

In the installed position of the lock cylinder 77, the locking member 82 of the lock cylinder 77 is behind the lock cover 75, namely displaced angularly with respect to a passage opening 84 in the lock cover 75 which extends radially to the cylinder core 83. The cross-section of the passage opening 84 is somewhat larger than that of the locking member 82. The passage opening 84 furthermore extends into the holding bushing 76.

A spring-loaded passage-blocking finger 85 extends into the passage opening 84. The blocking finger 85 is developed as a spring and is clamped in such a manner in a small pedestal 86 on the lock-case side that the bent, free end of the blocking finger 85 extends into the passage opening 84 and, thus also lies in the turning circle of the locking member 82. To make it possible for the locking member 82 to move away upon actuation by the key 78, the run-on bevels 87 and 88 are provided on the blocking finger 85. During the closing rotation, the blocking finger 85 accordingly moves away under spring action and then swings again into the advanced position.

Figure 23:
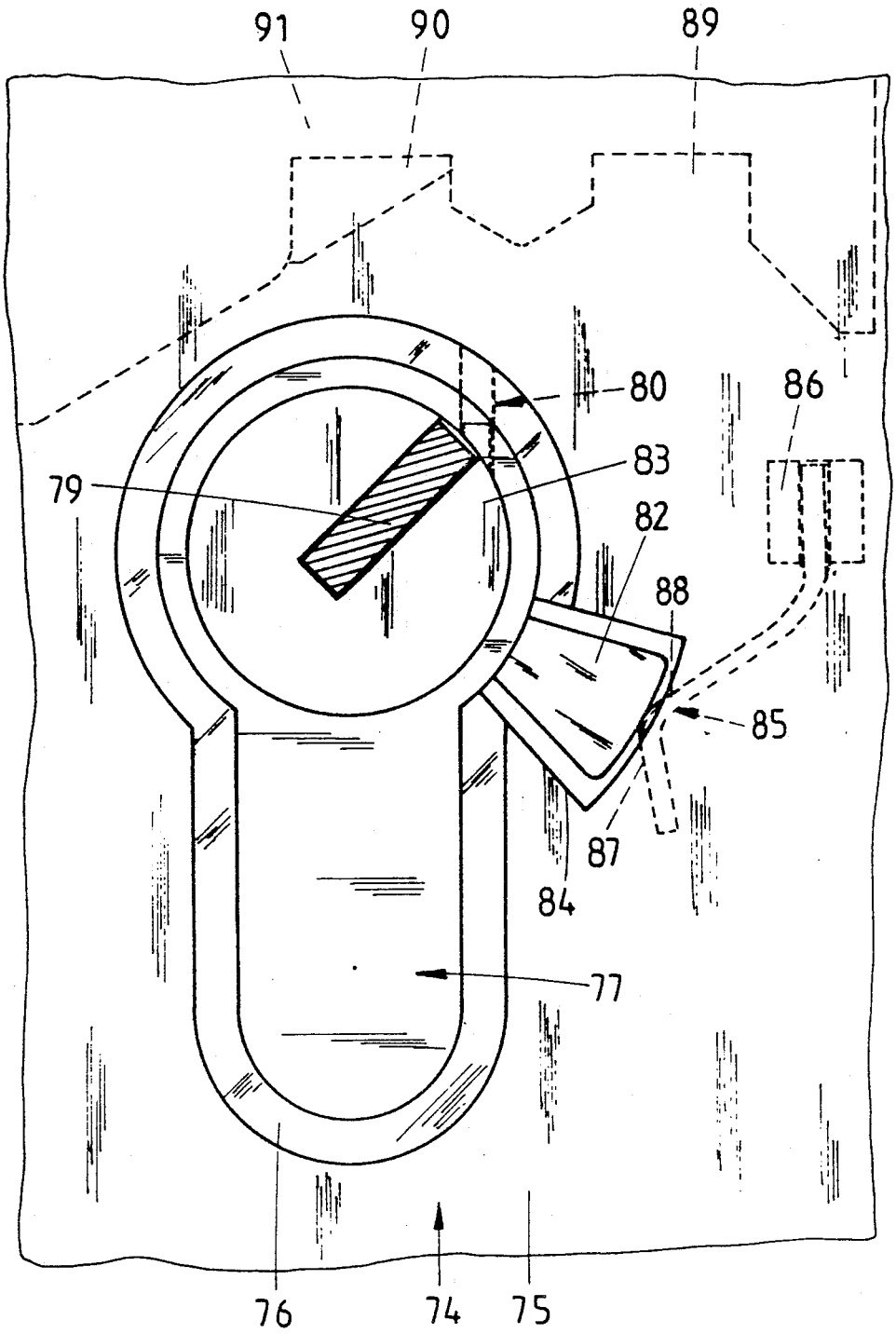
FIG. 23 is a view corresponding to FIG. 17, the cylinder core and thus the locking member having been turned through a limited angle of rotation by means of the removal key into the position in which the locking member is aligned with the passage opening.
Figure 24:
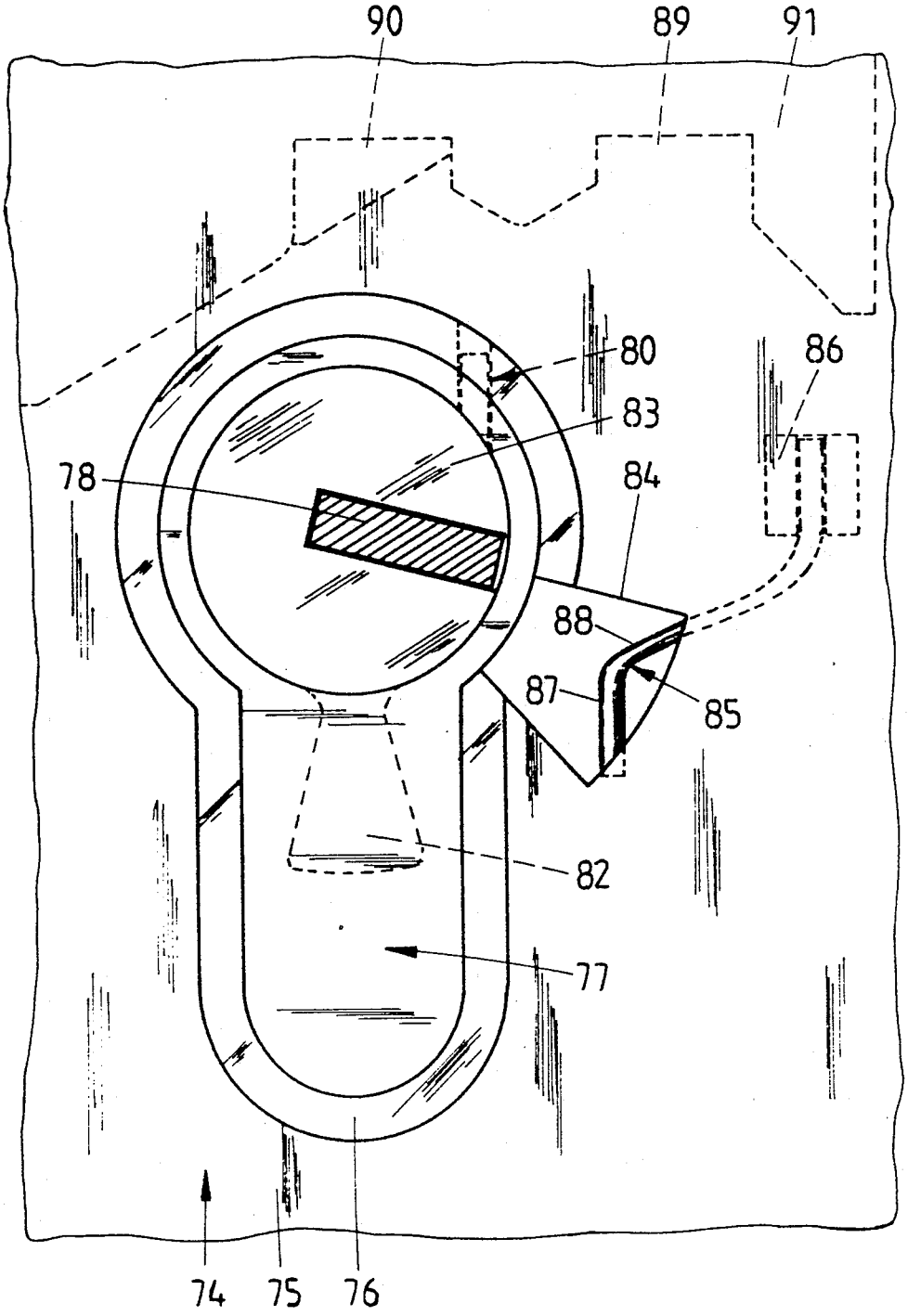
FIG. 24 is also a view corresponding to FIG. 17, with the normal key inserted in a position of the locking member which permits insertion of the lock cylinder into the holding bushing.

The removal key 79 is required for removal of the lock cylinder 77. By the removal key, the locking member 82 can be turned merely through a small angle and only in clockwise direction. This turning movement is limited and in this rotationally limited position the detent 80 between lock cylinder 77 and holding bushing 76 is eliminated. The locking member 82, which has displaced the blocking finger 85 into the position according to FIG. 23, is then aligned with the passage opening 84 of the lock cover 75. The lock cylinder 77 can thus be removed. As soon as the locking member 82 releases the blocking finger 85, the latter moves into its blocking position, so that re-insertion of the lock cylinder 77 by means of the removal key 79 is no longer possible. When insertion is attempted, the locking member 82 namely strikes against the blocking finger 85 so that the insertion movement is limited. An unauthorized attempt at opening by means of a copied removal key therefore leaves traces since the burglar can no longer install the lock cylinder.

The insertion of a new lock cylinder always requires the corresponding, normally shaped key 78 by which the locking member 82 can be brought beyond the limited angle of rotation into alignment with the cross-sectional area of the lock cylinder 77. Insertion can then take place by bringing about the detent action, see FIG. 24. The locking member 82 can then be turned by the key 78 into its basic position according to FIG. 17, in which the key can be pulled out of the cylinder core 83.

The bolt 75 can be advanced out of this position, the locking member 82 entering into the bolt-actuation opening 89 and/or 90 of the bolt 91. The swinging of the locking member into the bolt-actuation opening 89, 90 is, however, not possible by the removal key 79 due to the fact that the angle of rotation of the locking member is limited by a stop.

The basic principle of the lock cylinder which, while removable, can no longer be readily inserted with the same means can also be used to advantage, for instance, upon the delivery of locks. In the above-mentioned solutions of Austrian Patent No. 310 610, the installation of the locks in the locker doors takes place in the manner that the lock must be delivered together with the cylinder core. The installer of the lock must, therefore, receive either the individual key for the corresponding lock or a master key in order to verify the locking action of the installed lock. This does not exclude the possibility of keys falling into unauthorized hands so that access to locked lockers is possible with illegally made duplicate keys in order to steal objects stored in the lockers.

The basic principle of the invention thus also makes it possible to achieve, in addition, the object of optimizing the lock of a locking device of the type described from the standpoint of installation and security in such a manner that neither the individual key nor a master key need be turned over to the installer of the lock.

This object is achieved in a lock of the type described by features of the invention including a plug connection of the lock cylinder (18*a*, 83*a*) to the lock, which connection can be separated by means of the removal key (22*a*), that the bolt (42*a*) can be actuated by means of an auxiliary key (74*a*, 104*a*, 115*a*) when the lock cylinder has been removed.

According to this aspect of the invention, a lock of a locking device of the type provides increased security in addition to the advantages in installation. Upon a mounting of the lock, the lock cylinder need not yet be attached to the lock. The lock is supplied in this preassembled condition. In order to make it, nevertheless, possible for the installer of the lock to effect a closing of the bolt upon installation so as to test the operability, he . . . instead of an individual key or a main master key . . . establishes connection to the bolt. After mounting the locks, the corresponding lock cylinders are then inserted by a specially authorized person in the manner that, on the one hand, the cylinder core comes into coupling engagement and, on the other hand, the cylinder housing enters into the plug connection. The latter cannot be eliminated by the individual key corresponding to the lock cylinder but only by the removal key, so that unauthorized manipulations by means of the individual key are prevented.

One version is characterized by providing the cylinder core and the auxiliary key at their free ends with a pinion. The auxiliary key makes it possible, upon installation of the lock, to actuate the bolt by means of the pinion, the bolt being equipped for this purpose with a rack. When the lock cylinder is being installed, the pinion of the cylinder core meshes with the rack of the bolt.

Another mode of coupling the cylinder core or the auxiliary key with the bolt consists in providing a driver mounted in the lock for the coupling/plug engagement with the cylinder core and for actuation with the auxiliary key. In contradistinction to the state of the art, the driver is no longer a part of the cylinder core or seated on the end thereof but, rather the cylinder core can now be brought into coupling/plug engagement with the driver, resulting in the advantages mentioned above.

Different coupling/plug engagements can be realized on this basis. One mode employs a mounting of the driver in an opening in the lock cover. The establishing of the coupling connection between driver and cylinder core is in this case facilitated by the fact that the driver consists of a disk mounted in the opening in the lock cover. One version consists in forming the disk of two disk parts which are plugged together in the direction of their axis of rotation. One disk part then acts directly on the bolt with its control arm, while the other disk part, which is connected for rotation with the first disk part, has a polygonal recess for coupling engagement with the cylinder core.

By means of the auxiliary key, the disk part which otherwise faces the cylinder core can then be brought into the proper position in which insertion of the lock cylinder is possible. If the alignment of this disk part differs from that of the cylinder core, the coupling engagement is not possible. For the installation of the lock cylinder, there is preferably chosen a position in which the retracted position of the bolt is present. This means that after insertion of the lock cylinder in this position, the key cannot be removed. In order to advance the latter, the corresponding coin must be inserted as control element which, upon the advancing of the bolt, then permits the closing. In order to permit a closing of the bolt without insertion of a coin and with non-associated closing cylinder, the disk has an opening extending into the inside of the lock for a control projection on the auxiliary key. The latter can, at the same time, be the installation key in order to permit testing of the proper functioning of the lock upon installation of the latter on the door.

The support which extends from the lock cover and into the hollow space of which the lock cylinder can be inserted serves to safely hold the lock cylinder which is to be subsequently installed. In the final phase of the insertion movement a detent then enters into action which fixes the lock cylinder or the housing thereof in position. Removal thereof is thereupon possible only by means of a special key which overcomes this detent. Upon the use of such locks—for instance in a public bathhouse—there is the possibility of changing the lock cylinder if someone has not returned the key to a locker. The coin which has remained in the lock is then collected as fine. Unauthorized manipulations by means of a retained key are therefore not possible.

If the lock cylinder is not exchanged but the lock cylinder in question merely removed, then the disk part which forms the depression permits a rotational carrying along, by the auxiliary key the control projection of which acts via the opening. The circumferential groove of the disk part forms the depression in order to permit coin-free advancing. The locker can then brought again into locked position and can only be opened by the auxiliary key, which is in the hands of the supervisory personnel.

The transmission means, which the auxiliary key displaces with its control projection upon a locking, is the swivel arm which controls the bolt keeper in the position of release. If the bolt is advanced, then the swivel arm does not act on the bolt keeper. In this advanced position the lock cylinder cannot be installed. This requires the retracting of the bolt upon which process the control projection displaces the swivel arm which, in its turn, raises the bolt keeper and holds it in the raised position in the retracted position of the bolt.

In this position the lock cylinder can be installed since the coupling engagement between cylinder core and disk can be established. The bolt can then be advanced, and this without insertion of a coin, due to the raised position of the bolt keeper brought about by the swivel arm. The releasing of the bolt keeper fundamentally requires the advancing of the bolt.

The raised position is secured by the friction-locked application of the end of the swivel arm against the lower edge of the bolt keeper. The attachment is eliminated only when the bolt keeper strikes against a corresponding bolt bevel upon the advancing of the bolt and after it has traveled over a correspondingly long path. The bolt keeper is slightly raised thereby so that the swivel arm then returns into its starting position. The friction-locked application between the swivel arm and the bolt keeper takes place in this connection in the region of the crescent-shaped projection of the latter, the application edges of crescentshaped projection and swivel arm end swinging over intersecting arcs which presuppose intentional release of the friction-locked application.

In another version of the invention, the disk is developed as a hub which is equipped with a control arm and which has a polygonal depression for coupling to an extension on the cylinder core. The disk can then be made in one part. It itself has the depression for the coupling to the extension of the cylinder core. In such a case it is favorable to have the extension of the cylinder core form the opening from which, on the inner side of the lock, there proceeds a partial annular groove into which the control projection of the auxiliary key extends. If the lock cylinder is not installed, then the auxiliary key can become active by its control projection acting against the corresponding flank of the swivel arm upon its closing rotation.

In order to hold the disk securely when the lock cylinder has been removed, there being therefore no coupling between disk and extension on the cylinder core, the hub of the disk has a bearing collar which is connected to the control arm via an arcuate web. Upon the installation of the lock cylinder, the proper coupling can therefore always be produced, namely in the appropriate position of rotation of the hub or disk. The lock cylinder is imparted a sufficiently firm seat by the fact that the support is developed as a bushing in the bottom region of which the disk which is accessible.

In a divided disk the bushing can, in addition, assume the function of mounting the disk part which is to be coupled to the cylinder core. The bushing can furthermore serve as a mounting for the auxiliary key. This, however, presupposes that the opening of the mount for the corresponding disk part extends concentric to the inner wall of the bushing. In such a case the width of the plate-shaped auxiliary must be adapted to the inside diameter of the bushing.

Three additional embodiments of the invention will be described now with references to FIGS. 1*a* to 22*a*.

In another version of the invention, the lock of the first additional embodiment shown in FIGS. 1*a* to 16*a* has a lock case 2*a* attached on the inside of a locker door 1*a* of a public bathhouse, the lock case having a lock bottom 3*a* and, bent off from the latter, the lock-case sidewalls 4*a*, 5*a*, 6*a* and 7*a*. The upper lock-case sidewall 7*a* continues into a hood which on its one inclined sidewall 8*a* has a slide 9*a* with a calibrated coin-insertion slot 10*a*.

The lock ward is covered by a lock cover 11*a*. The latter serves to hold a support developed as bushing 12*a*. For the fixing in position of the bushing 12*a*, screws (not shown) can be used which are screwed in from the inside of the lock cover 11*a* and engage into the bottom region 13*a* of the bushing 12*a*. The bottom region 13*a* is provided with a bearing opening 15*a* which extends eccentrically to the bushing wall 14*a* and through which the cylinder core 16*a* of a lock cylinder 18*a* mounted in the cylinder housing 17*a* passes, the lock cylinder being installed in the bushing 12*a* and its end surface terminating in installed condition flush with the outer end wall of the bushing 12*a*.

Figure 7:
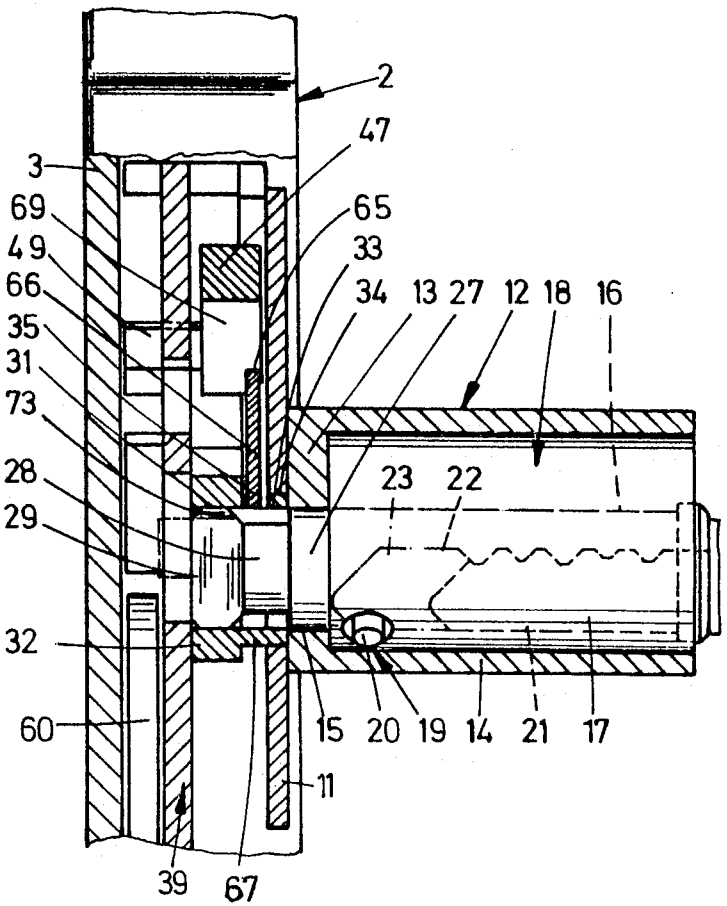
FIG. 7 is a section along the line VII—VII in FIG. 6.
Figure 7A:
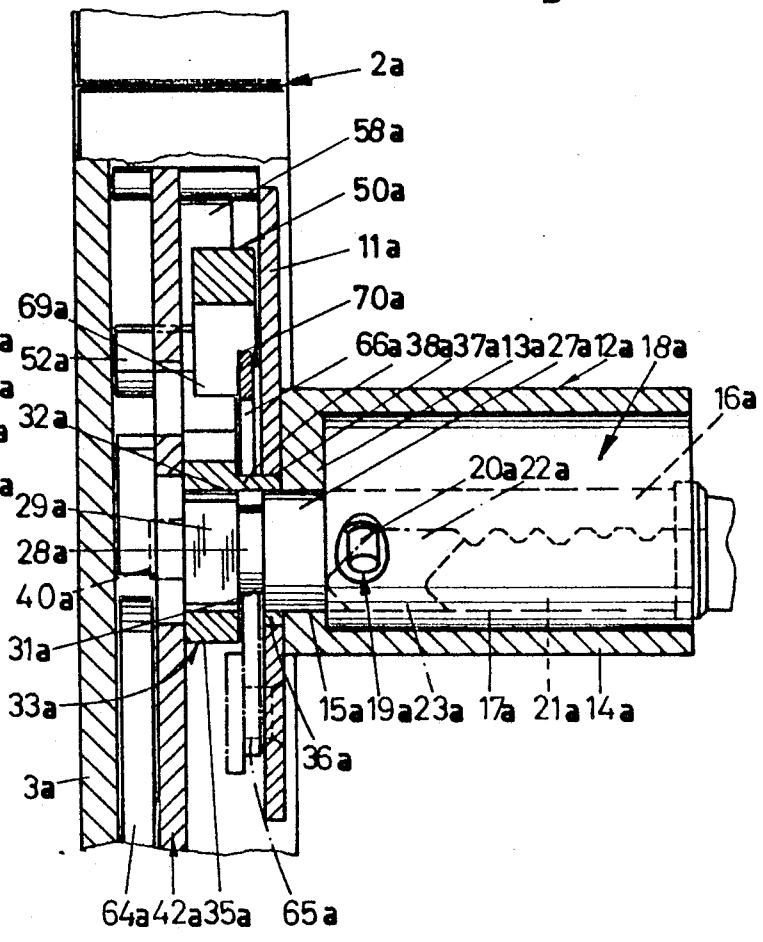
FIG. 7*a* is a section along the line VII—VII in FIG. 6*a*.
Figure 12:
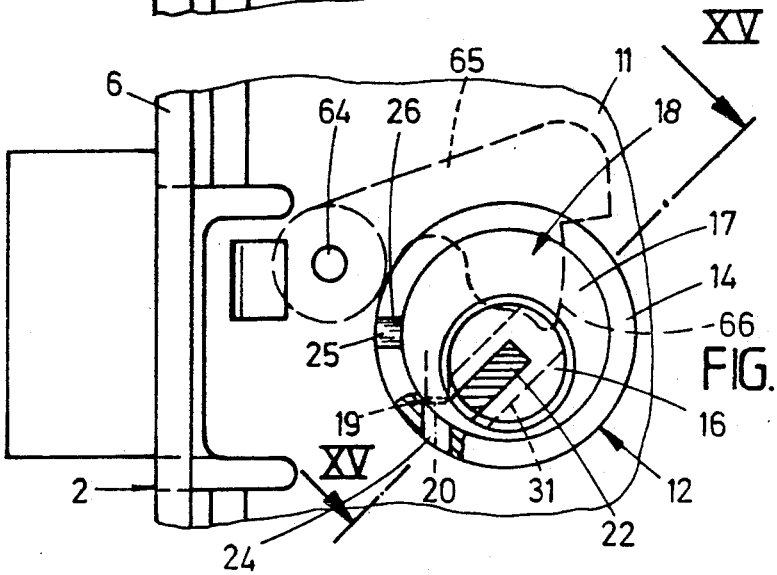
FIG. 12 is a view corresponding to FIG. 11, the cylinder core having been turned by the removal key through a limited angle of rotation.
Figure 12A:
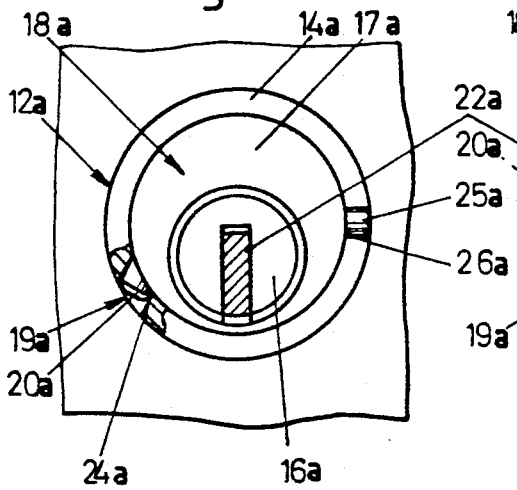
FIG. 12*a* is a view of the lock cylinder seated in a bushing, shown broken away in the region of the detent and with the special key inserted corresponding to the key removal position of the lock cylinder.

The lock cylinder 18*a* is secured against turning and removal by a detent 19*a* in the bushing 12*a*. The detent is a detent pin 20*a* which is guided in the cylinder housing 17*a* in secant-like alignment, is urged by spring action in outward direction, the pin being located on the inner end of the lock cylinder and a region of which (not shown) extends into the cylinder core 16*a*. An individual key 21*a* shown in FIG. 8*a* and belonging to the lock cylinder 18*a* cannot reach the detent pin 20*a* in its inserted position shown in FIG. 7*a*. This is possible only by means of a special key 22*a* which is longer than the individual key 21*a* and the key tip 23*a* of which extends in inserted position up to the detent position 19*a*. In the key removal position of the lock cylinder 18*a*, the position shown in FIG. 12*a* is present. The detent pin 20*a* is then in engagement with a detent opening 24*a* in the bushing wall 14*a*. This position is secured in addition by a radial pin 25*a* which is attached in the front end region of the cylinder housing 17*a* and which extends into a groove 26*a* of the bushing wall 14*a*, the groove being open at its edge.

Figure 13A:
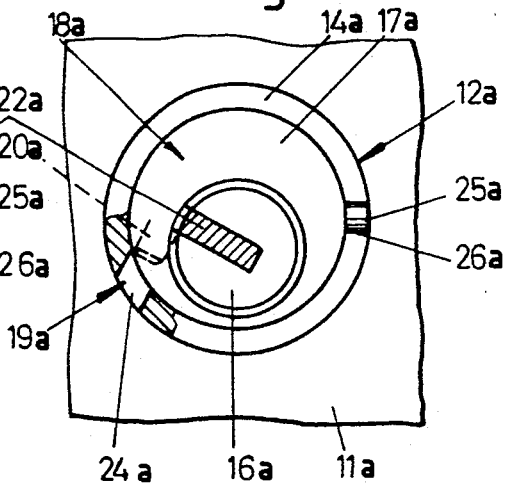
FIG. 13*a* is a showing corresponding to FIG. 12*a*, the cylinder core having been turned by means of the special key into the position which corresponds to the retracted position of the bolt.
Figure 14A:
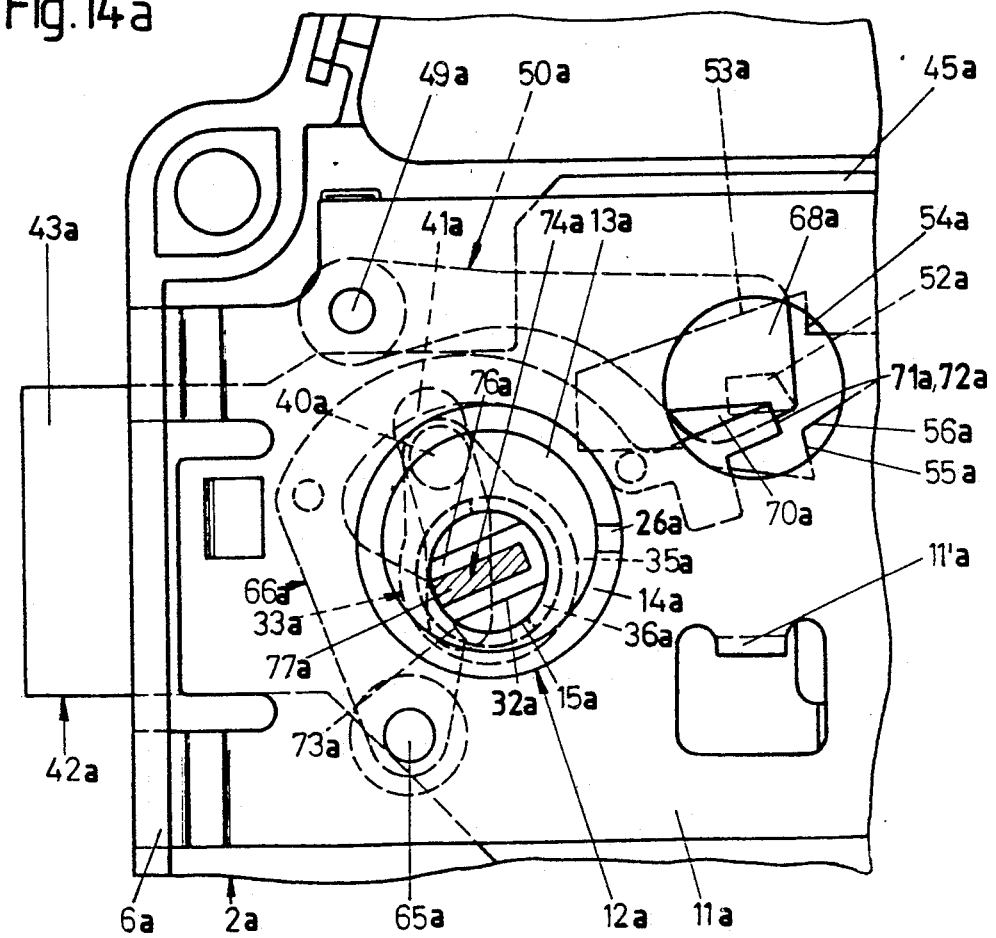
FIG. 14*a* is a rear view of the lock with the lock cylinder already removed from the bushing and with the auxiliary key inserted during the retraction of the bolt and with the bolt keeper raised by the swivel arm.
Figure 14:
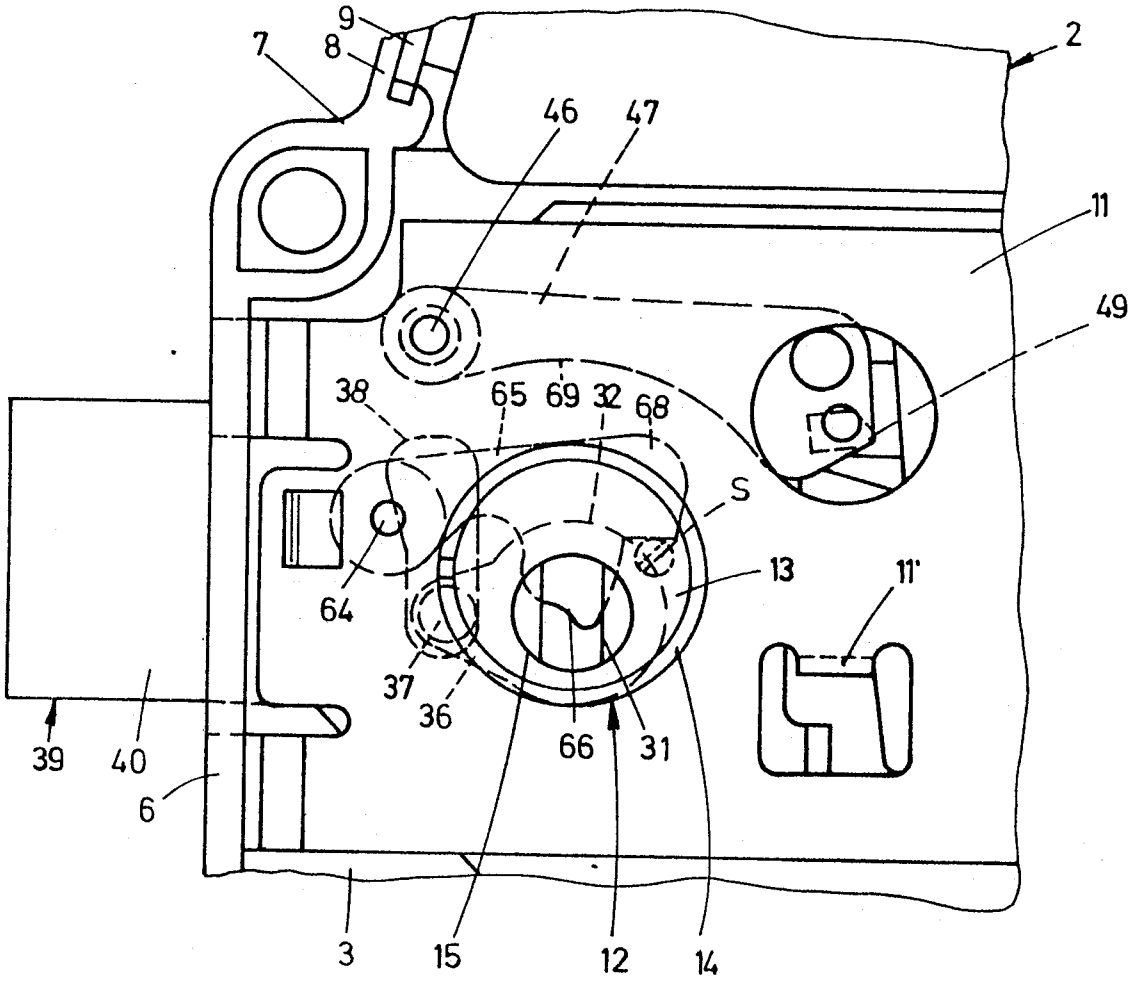
FIG. 14 is a view corresponding to FIG. 6, but with the lock cylinder removed and with the blocking finger moved in front of the bolt-actuation opening.
Figure 15:
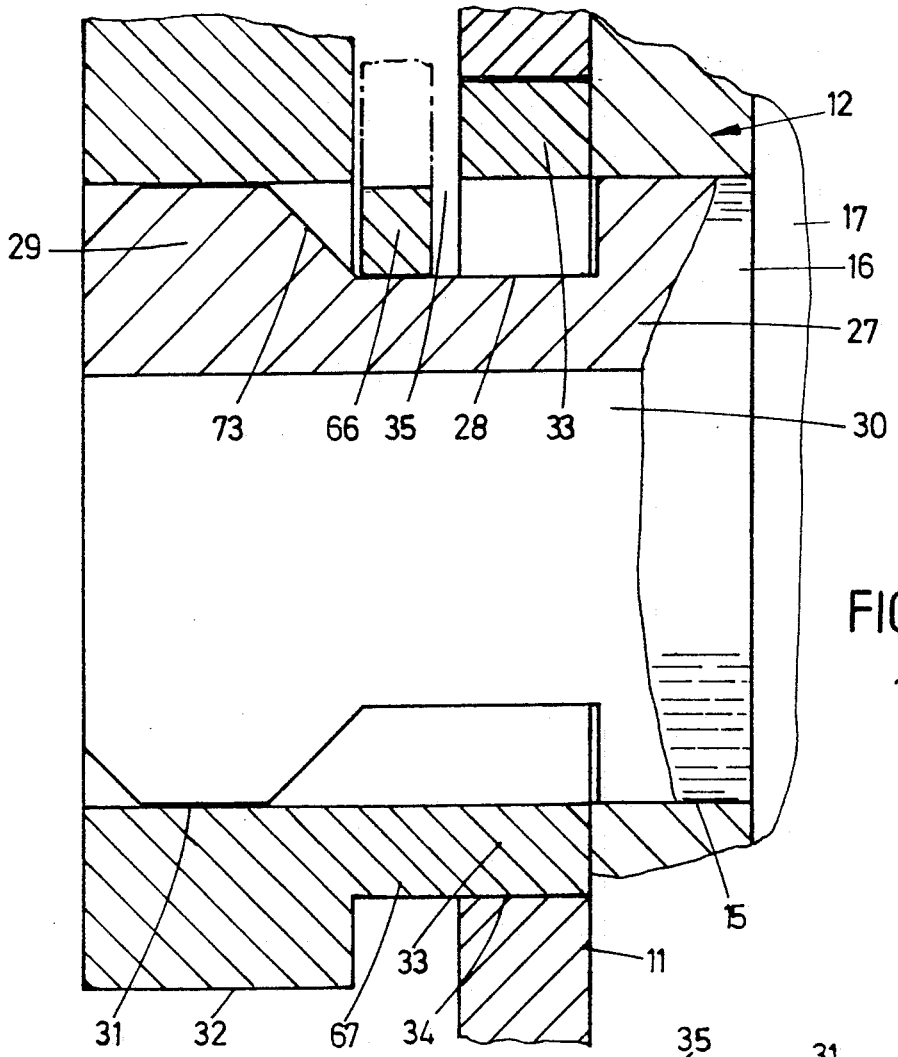
FIG. 15 is a section along the line XV—XV of FIG. 12.
Figure 16:
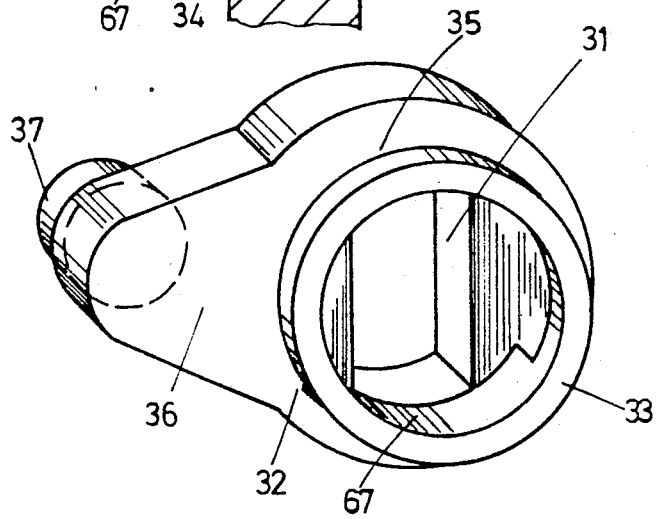
FIG. 16 is a perspective view of the bolt driver having the bolt-actuation opening.
Figure 17:
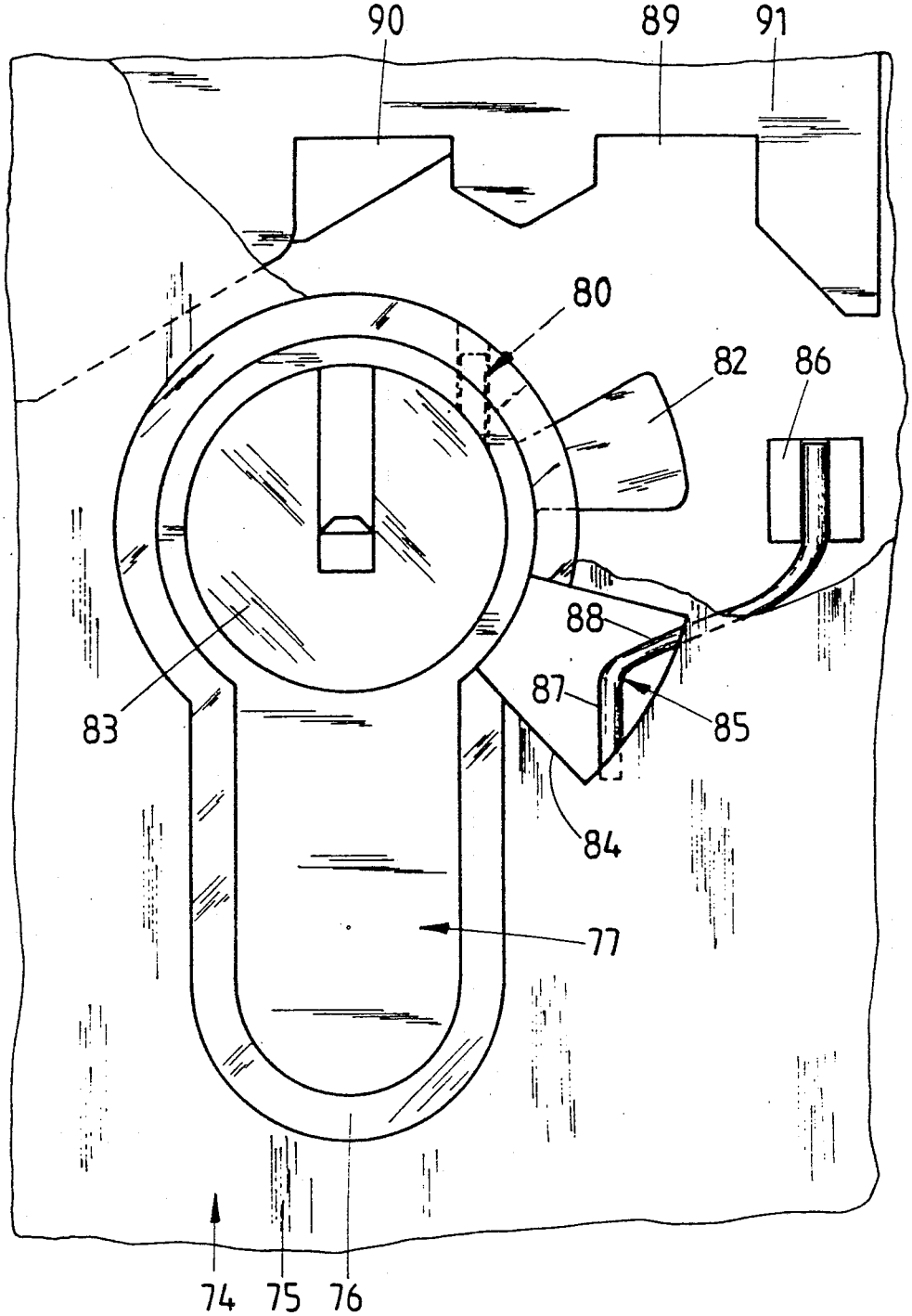
FIG. 17 is a partial section through the locking device of the second embodiment, namely in the region of the lock cylinder, corresponding to the basic position of the locking member.
Figure 18:
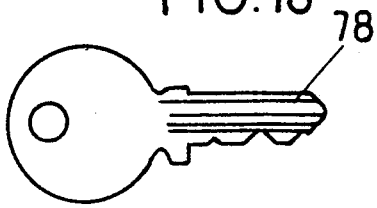
FIG. 18 is a view of the normal key suitable for this locking device.
Figure 19:
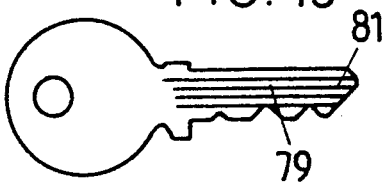
FIG. 19 is a view of the removal key, which has a longer shank than the individual key.
Figure 20:
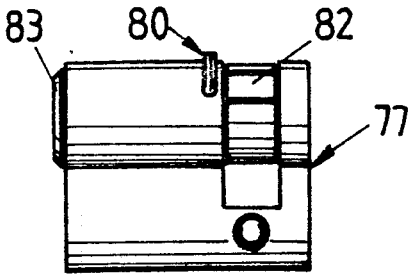
FIG. 20 shows the lock cylinder of the locking device in approximately normal size.
Figure 22:
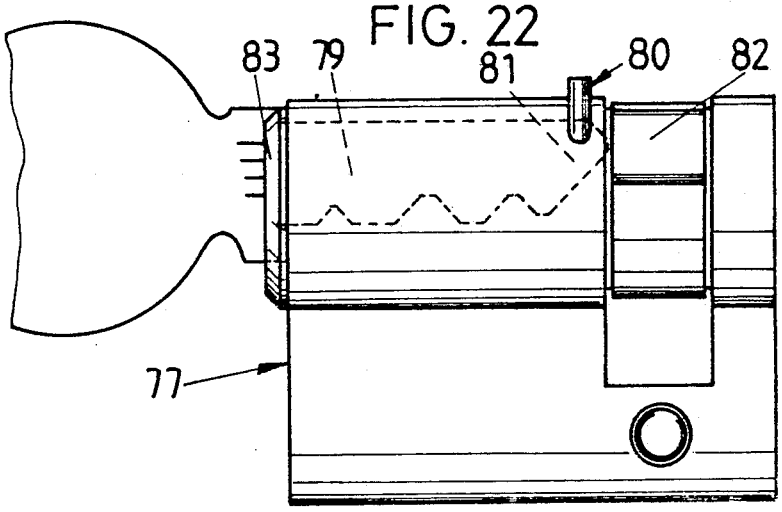
FIG. 22 is a view corresponding to FIG. 21, with the removal key inserted into the key channel of the cylinder core.

If the special key 22*a* is turned in clockwise direction into the position shown in FIG. 13*a* and therefore by more than 90°, it moves out of the detent opening 24*a* in the bushing wall 14*a*. The lock cylinder 18*a* can then be pulled out of the bushing 12*a*. The insertion of the lock cylinder, on the other hand, can be effected by means of the special key 22*a* or without it. To permit insertion of the lock cylinder 18*a*, the detent pin 20*a* must then be pushed back. Upon reaching the end position of insertion, the detent pin 20*a* enters into the detent opening 24*a* and secures the installed position of the lock cylinder.

The extension 27*a* of the cylinder core 16*a* which protrudes beyond the inner end of the lock cylinder 18*a* is provided with a circumferential groove 28*a* which is located on the inner side of the lock case and which a polygonal section 29*a*, obtained by flattening on both sides, adjoins. The key slot 30*a* continues into the polygonal section 29*a* and thus forms in the region of the extension 27*a* and opening 31*a* which intersects the circumferential groove 28*a*.

The polygonal section 29*a* engages into a crosssectionally adapted polygonal depression 32*a* in a disk 33*a*. The latter is developed as hub 35*a* provided with a control arm 34*a*. The hub 35*a* is provided with a bearing collar 36*a* which engages into a bearing bore hole 37*a* of the lock cover 11*a* and extends up to the bottom region 13a of the bushing 12a. The connection of the bearing collar to the hub 35a is effected by an arcuate web 38a. In this way there is created a partial annular groove 39a which is at the level of the circumferential groove 28a. A strong plastic is used as material for the disk 33a as well as for the bearing collar 36a and the arcuate web 38a.

The control arm 34a serves as support for a coupling pin 40a which is directed toward the inside of the lock and which engages into a transverse slot 41a of a bolt 42a guided in the lock case 2a. The head 43a of the bolt passes through a cross-sectionally adapted opening 44a of the sidewall 6a of the lock case and cooperates with a closure plate (not shown) of the locker on the side of the fixed frame. The further guidance of the bolt 42a is effected by a slot 46a which is provided in the bolt tail 45a, extends in exclusion direction and is open at its edge and into which a square pin 47a on the side of the lock case extends. The bolt tail 45a serves as support for a torsion spring 48a which urges the bolt 42a in the direction toward the inside of the lock.

A bolt keeper 50a developed as one-arm lever is mounted above the bolt head 43a around a support pin 49a on the side of the lock case. The bolt keeper is urged by a leaf spring 51a in clockwise direction. A blocking finger 52a extends from the broadside of the bolt keeper 50a facing the bolt tail 45a, the bolt finger extending up to the inner surface of the lock bottom 3a and passing through a shaped recess 53a in the bolt tail 45a. This recess 53a is provided with blocking edges 54a, 55a extending transverse to the direction of closing. The rear region of the recess 53a forms a bolt bevel 56a, the action of which will be described below. When the bolt 42a is retracted, the blocking finger 52a rests in the front region of the recess 53a against its lower edge, see FIG. 3a.

Figure 3A:
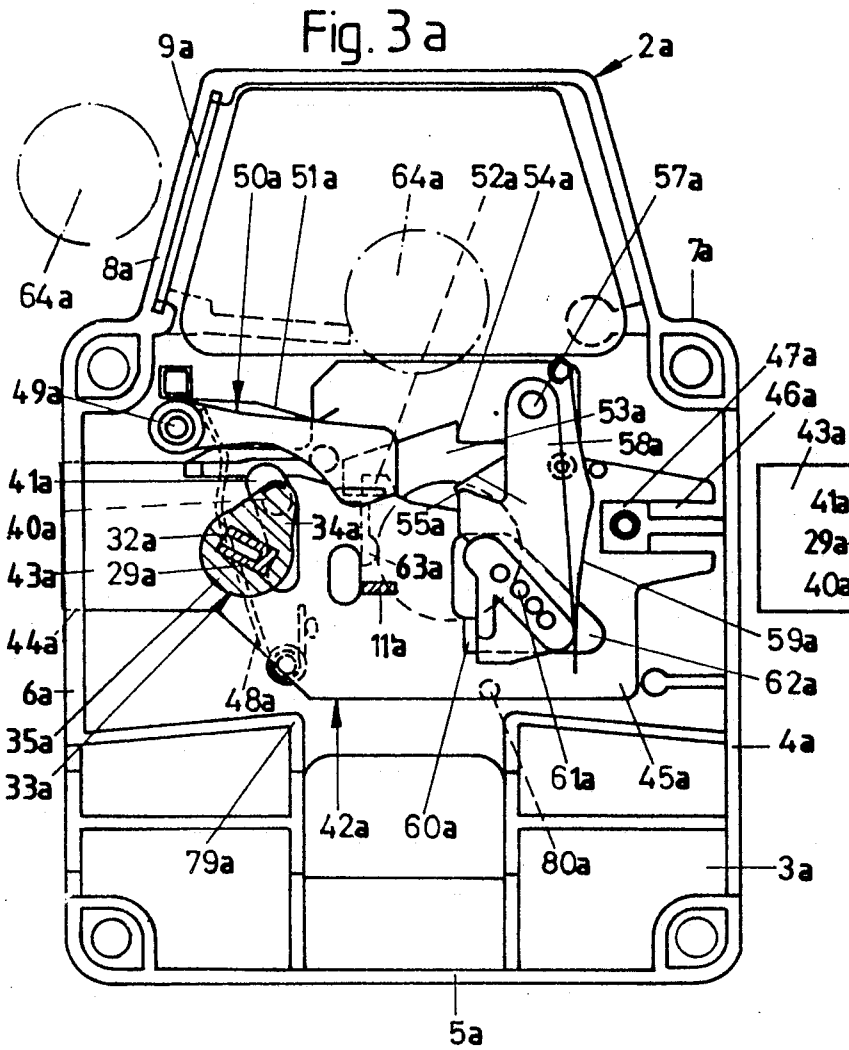
FIG. 3*a* is a rear view of the lock with the bolt retracted and the lock cover removed.
Figure 5:
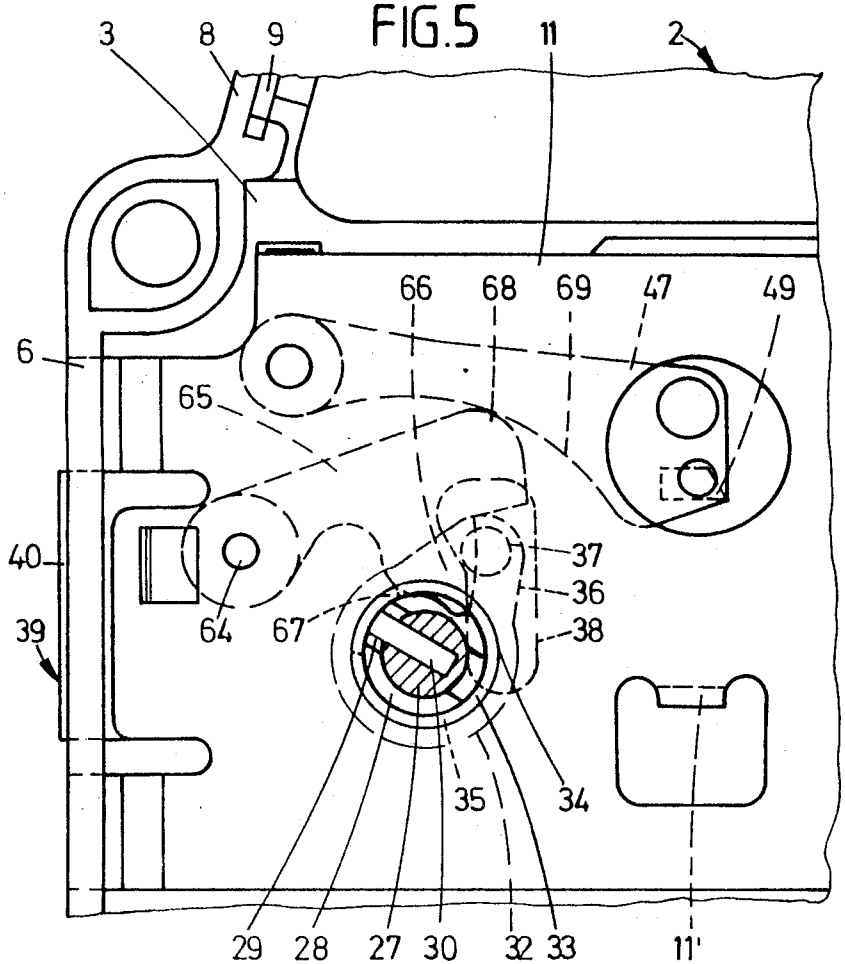
FIG. 5 is a rear view of the bolt lock seen on a larger scale, in the region of the lock cylinder, with the bolt retracted.

In the upper rear region of the bolt tail 45a, a rocker arm 58a is mounted around a pin 57a on the side of the bolt tail and is urged in clockwise direction by a leaf spring 59a. A projection 60a on the side of the bolt tail serves to limit the swinging motion of the rocker arm, the lower end of the rocker arm 58a resting on said projection. The rocker arm serves as support for a supporting pin 61a which passes through a recess 62a in the bolt tail 45a and extends up to the lock bottom 3a. The support pin 61a cooperates with a support shoulder 63a on the side of the bolt. The distance between the support shoulder and the support pin 61a is smaller than the diameter of a coin 64a inserted into the in-insertion slot 10a so that the coin, as shown in FIG. 3a, is held by the support shoulder 63a and the support pin 61a only after its insertion.

Figure 2A:
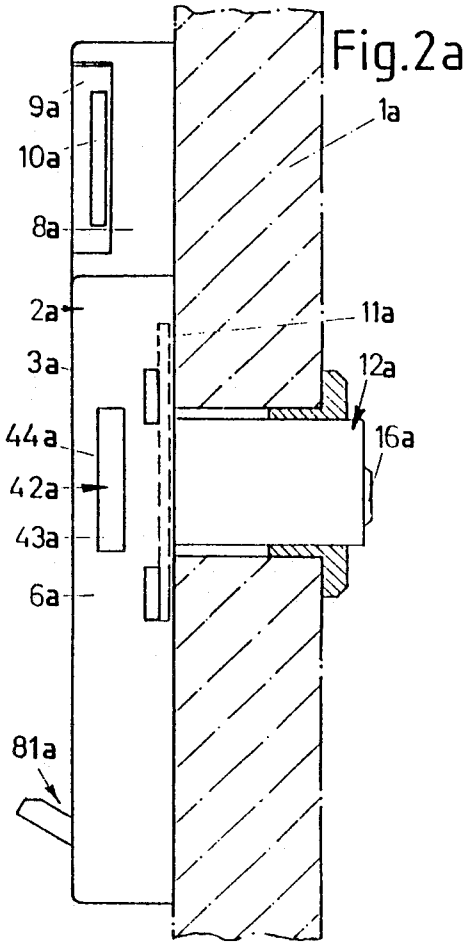
FIG. 2*a* is a side view of the lock seen in the direction toward the coin-insertion slot.
Figure 1A:
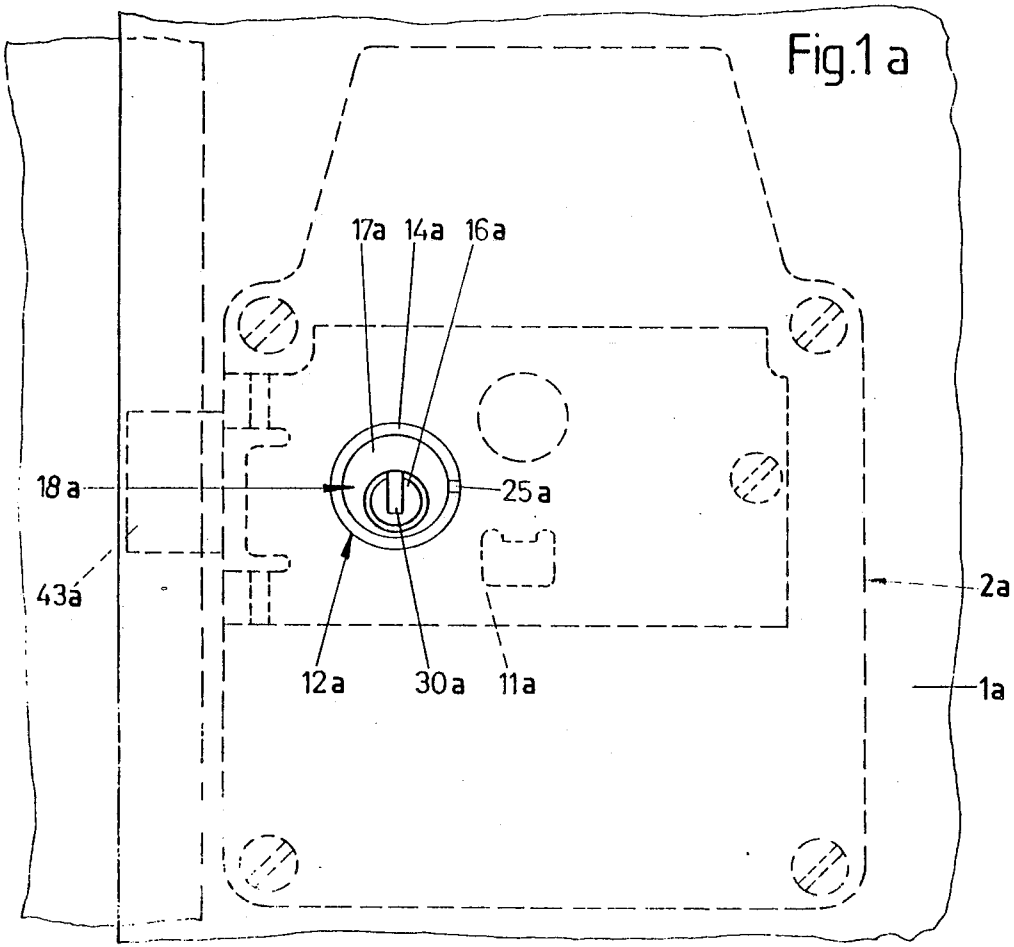
FIG. 1*a* is a front view of a locker door having a lock according to the first embodiment attached to its inner side with the bolt advanced.
Figure 4:
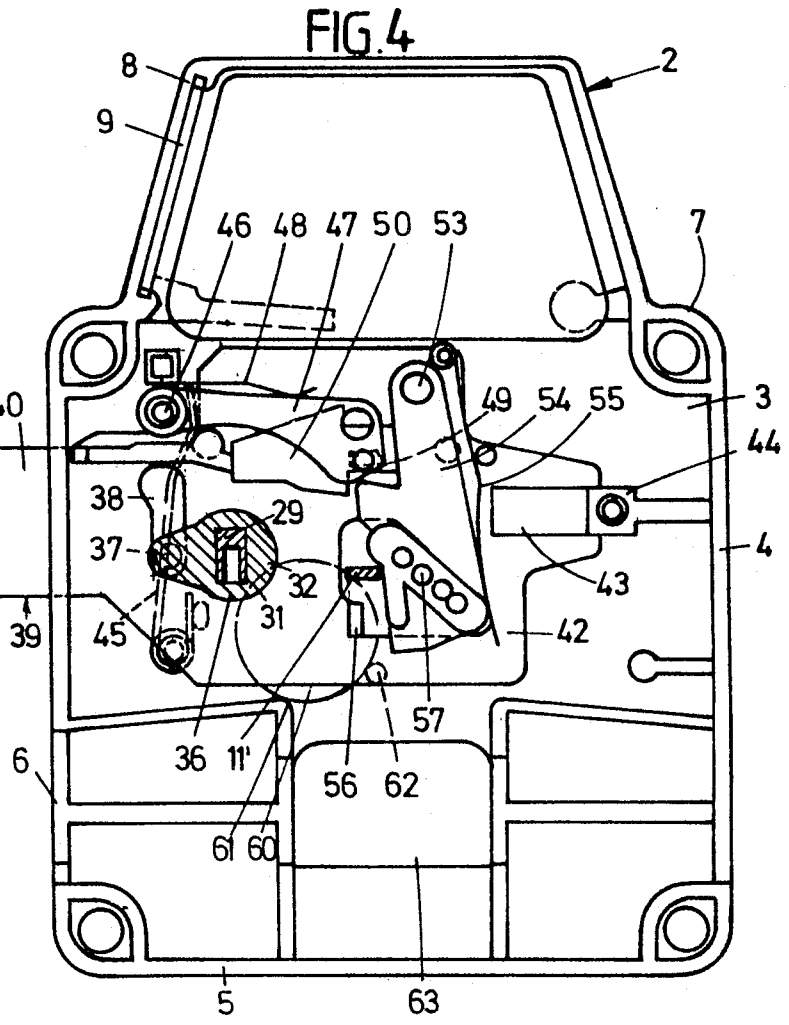
FIG. 4 is a view similar to FIG. 3, with the bolt advanced.

The insertion of the coin 64a is possible because the locker door is in open position. The individual key 21a is then also inserted into the lock. The locking turn can now be carried out, the carrying along of the bolt 42a in the exclusion direction taking place via the control arm 34a of the hub 35a. Together with the advancing movement thereof, the coin 64a is also carried along and acts with its edge on the blocking finger 52a and thus raises the bolt keeper 50a into such a position that the blocking finger is not disturbingly in the way of the blocking edges 54a, 55a of the bolt tail 45a. As a result of this, the bolt 42a can be completely advanced into the position shown in FIG. 2a in which the individual key 21a can be pulled out of the lock cylinder 18a. During the advance, the rocker arm 58a strikes against a bend 11a' of the lock cover 11a and is swung thereby, releasing the coin 64a for dropping down, the coin being then held in an intermediate position by a shoulder 79a on the housing side and a bearing pin 80a of the bolt 42a. Upon the retraction of the bolt 42a, the coin 64a passes into a coin-return compartment 81a. The lock accordingly operates in accordance with the deposit principle.

Figure 5A:
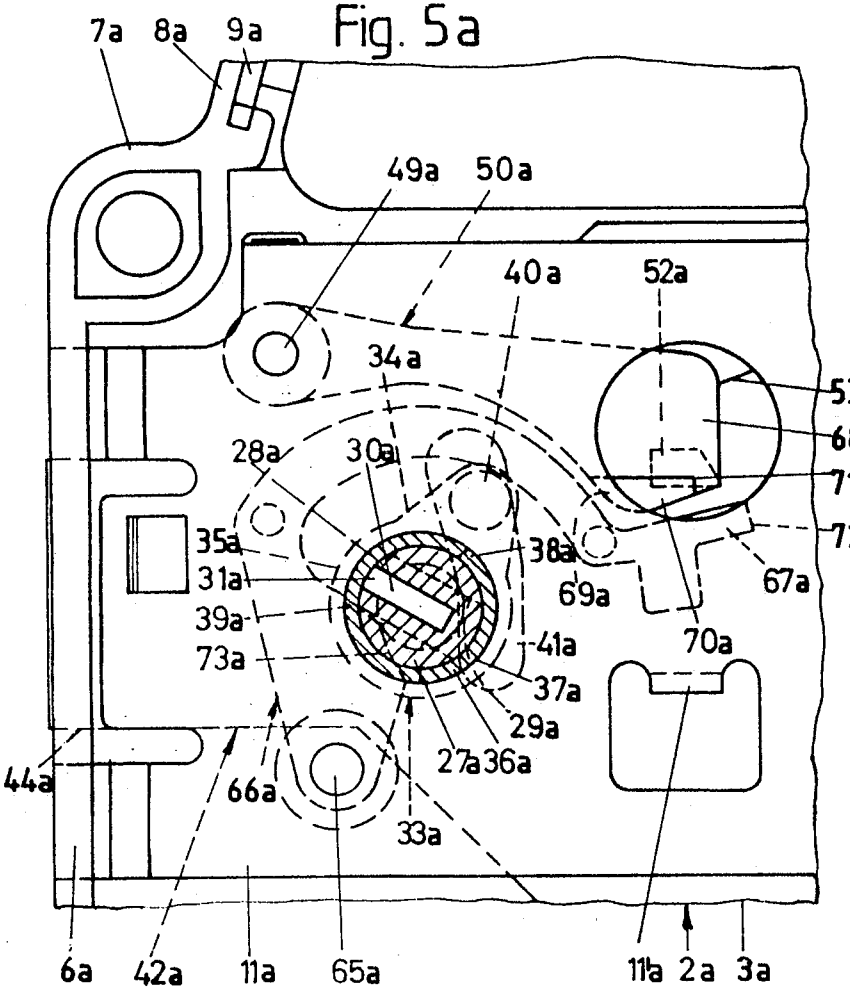
FIG. 5*a* is an enlarged rear view of the lock in the region of the lock cylinder, with the bolt retracted.

The lock cover 11a bears in its lower region facing the bolt head 43a a swivel arm 66a around a pin 65a, the swivel arm being guided in the form of an arc around the control arm 34a in such a manner that the swivel arm end 64a lies below the end 68a of the bolt keeper 50a. The lower edge of the end 68a is formed into a crescent-shaped projection 69a. The bolt keeper 50a has at that place a recess 70a which faces the lock cover 11a and, in its turn, lies in the plane of the swivel arm 66a or of the swivel arm end 67a, respectively. The recess 70a creates a bearing edge 71a which cooperates with the bearing edge 72a of the swivel arm end 67a. A flank 73a serves to control the swivel arm 66a, the flank engaging into the circumferential groove 28a when the lock cylinder 18a is inserted and resting against the bottom thereof; see FIG. 5a. The bearing edges 71a and 72a are then located above each other and are therefore not in engagement. The engaging of the flank 73a is made possible by the partial annular groove 29a of the hub 35a.

Figure 6:
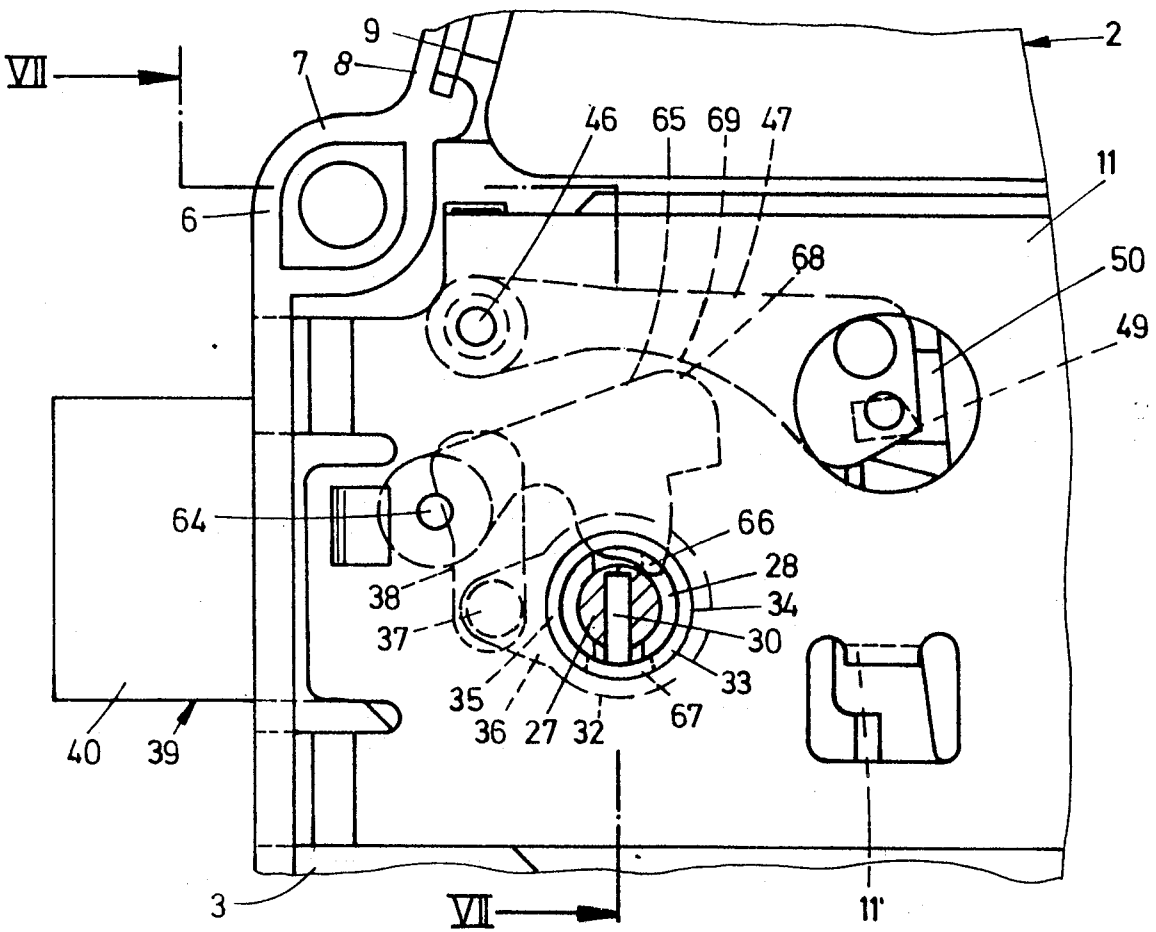
FIG. 6 is a view corresponding to FIG. 5, with the bolt advanced.
Figure 6A:
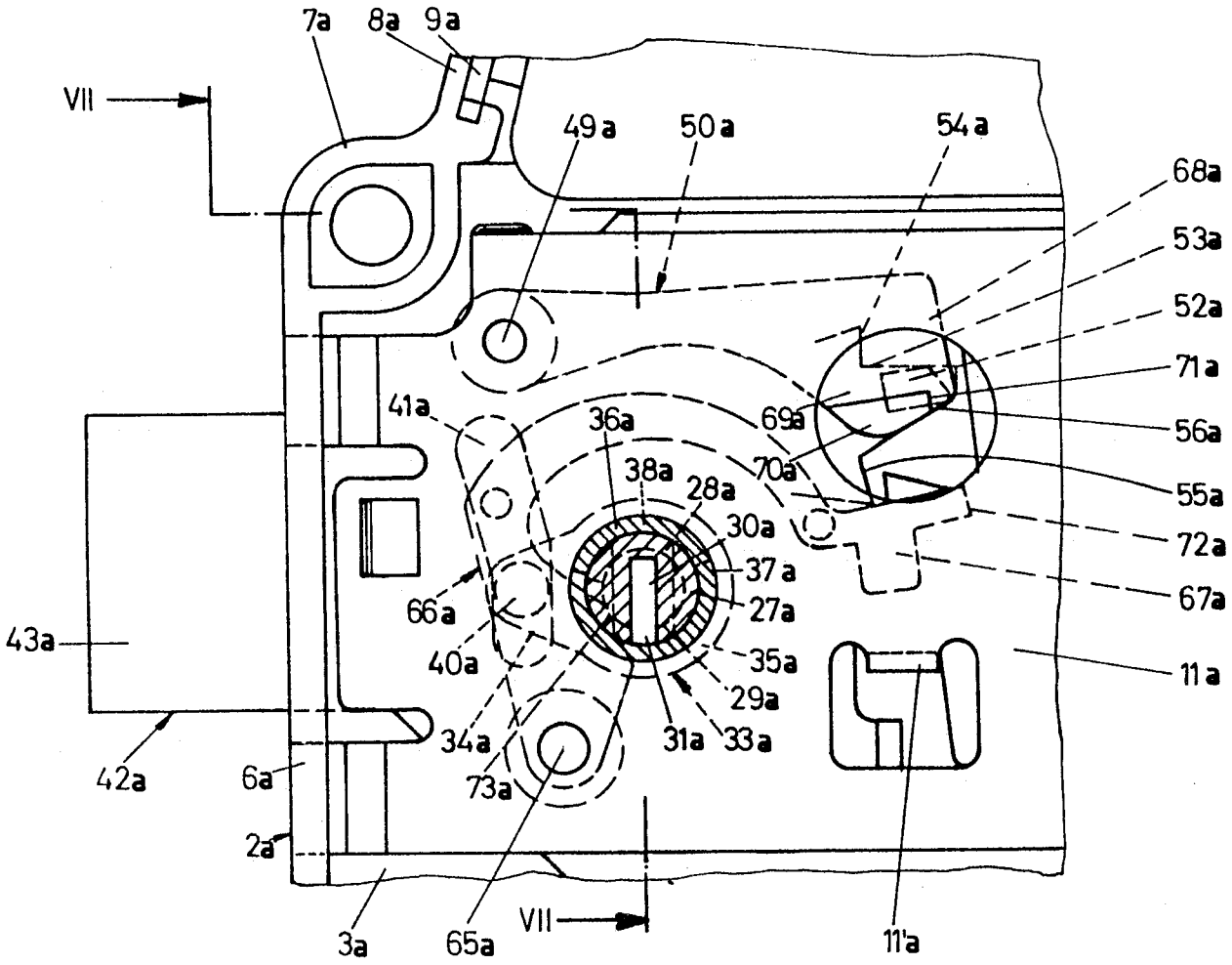
FIG. 6*a* is a showing corresponding to FIG. 5*a*, with the bolt advanced.
Figure 8A:
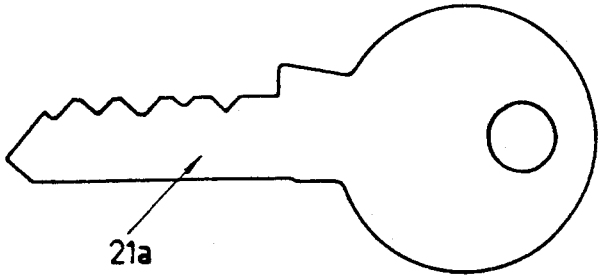
FIG. 8*a* is a view of the corresponding individual key.

The lock can be actuated by an auxiliary key 74a when the lock cylinder 18a is not installed. The key shank 75a thereof bears at its end a coupling piece 76a the crosssection of which is adapted to the polygonal depression 32a in the disk 33a. Furthermore, adjoining the coupling piece 76a, a control projection 77a is provided on one narrow edge of the key shank 75a for cooperation with the swivel arm 66a. Opposite the control projection 77a there is a recess 78a so that the flank of the key shank 75a opposite the control projection cannot exert any action on the swivel arm 66a. The auxiliary key 74a is provided with an insertion limitation by transverse steps 79a located at the same height. The region 75a' adjoining said steps in the direction of the coupling pieces 76a is adapted in its width to the diameter of the bearing opening 15a in the bottom region 13a of the bushing 12a. It is possible by means of this auxiliary key 74a to advance the bolt without the insertion of a coin. If the auxiliary key 74a is inserted in the proper position when the bolt is retracted, then the control projection 77a acts on the flank 73a of the swivel arm 66a upon the advancing. This action is made possible by the partial annular groove 39a into which the swivel arm engages with its flank 73a. Upon the locking turn of the auxiliary key 74a, the bolt 42a is advanced. At the same time, the control projection 77a swings the swivel arm 66a in counterclockwise direction. The latter raises, in this case, with its swivel arm end 67a the bolt keeper 50a in such a manner that the blocking finger 52a does not impede the advancing. In the advanced position the finger 52a then rests against the bolt bevel 56a, as has also been shown in FIG. 6a.

The retracting of the bolt 42a is also possible from the advanced position by means of the auxiliary key 74a. In an intermediate phase of the locking turn, the control projection 77a acts on the flank 73a of the swivel arm 66a and displaces the latter, the bearing edges 71a and 72a of the bolt keeper 50a and of the swivel arm end 67a coming into engagement. This engagement is retained even after completion of the retraction turn, i.e. when the bolt has been retracted. An automatic release of the frictional engagement between the bearing edges does not occur since the bearing edges 71a and 72a swing over intersecting arcs B1 and B2; see in particular FIG. 15a. This is the position which is, as a rule, left by the installer of the lock. The lock cylinder 18a can then be inserted in the manner described above, the extension 27a on the cylinder core 16a coming into coupling engagement with the driver mounted on the lock side or the disk 33a and the lock cylinder 18a entering into the plug connection which can be released from the outside.

If the user of a locker does not return the key 21a, this construction furthermore affords the possibility of removing the lock cylinder 18a, namely after retraction of the bolt 42a by the special key 22a, upon which locking displacement the coin 64a drops into the coin return compartment 81a. In the retracted position, the lock cylinder 18a can be removed and replaced by another one. However, if the locker is to be closed again without the insertion of a coin, then the auxiliary key can be used by means of which the bolt can be advanced and then retracted again so that one obtains the position shown in FIG. 15a. The bolt keeper 50a, borne by the swivel arm 66a is then in raised position. The new lock cylinder must be inserted in this position. Upon the advancing which then takes place and which can be carried out without the insertion of a coin, the engagement between the bearing edges 71a and 72a of the bolt keeper 50a and the swivel arm 66a, respectively, is eliminated.

However, it is possible that after the removal of the lock cylinder 18a the advancing of the bolt 42a is to require the insertion of a coin. In that case, one uses the tool key 82a shown in FIG. 11a which merely forms a coupling piece 76a and does not have a control projection. At the corresponding places, the tool key 82a is provided with edge cutouts 82a'', the bearing region 82a' of the tool key 82a adjoining said cutouts. Upon the advancing of the bolt, the bolt keeper must therefore be raised by the edge of the coin.

In the modified embodiment shown in FIG. 17a, the closing cylinder bears the reference number 83a. It is provided with a detent pin 84a which can be displaced by a special key. Adjacent to the detent pin there is another spring-loaded pin 85a which does not require special displacement by the special key. The pins 84a and 85a cooperate with corresponding holes 86a, 87a in a bushing 88a which is to be attached in similar manner on the lock cover 11a. In addition to the two pins 86a, 87a, there is also provided a ball-like adjustment projection 89a for which the bushing 88a has on its inside a groove 90a which is open at its edge.

In contradistinction to the first embodiment, the bushing 88a has a centering collar 91a which is received in form-locked manner by a hole 92a in the lock cover 11a.

The driver which moves the bolt also consists of a disk mounted in the opening of the lock cover 11a, the disk being formed, in its turn, by two disk parts 93a, 94a connected as plug connections in the direction of their axis of rotation. The one disk part 93a continues into a control arm 95a which has a coupling pin 96a and engages on the bolt 42a. The other disk part 94a, on the other hand, is provided with a polygonal depression 97a for a coupling engagement with the facing end 98a' of the cylinder core 98a. This disk part 94a is mounted in a stepped central hole 99a in the bottom region 100a of the bushing 88a. The end 101a of the disk part 94a which protrudes beyond the bottom region engages in formlocked manner into a coupling recess 102a of the coupling part 93a.

Also in this second solution the disk, which consists of the two disk parts 93a, 94a, has an opening 103a which extends along the extension of the key channel of the cylinder core 98a. This opening 103a permits the use of an auxiliary key 104a which is shown in dash-dot line in FIG. 18a, the control projection 105a of which extends into the opening 103a, engages there into the circumferential groove 109a and effects the displacement of the swivel arm. The insert position of this auxiliary key 104a is limited by shoulders 106a which rest against the inner bottom surface of the bushing 88a. The control of the lock by means of the auxiliary key 104a corresponds to that of the previously described embodiment.

In order to establish a good mounting of the auxiliary key 104a it has been developed as a plate the width $\times$ of which has been adapted to the inside diameter y of the bushing.

The tool key 107a shown in FIG. 19a is provided at the end of its shank with a drive projection 108a which merely makes it possible to establish a coupling engagement with the disk part 94a. A displacement of the swivel arm 66a cannot take place upon the locking rotation.

Both embodiments can also permit the direct fine-collecting function, without the indirect procedure via the auxiliary key. The special key, which represents a cylinder-replacement key, must in such case merely be extended into the region of the circumferential groove 28a of the cylinder core 16a or of the circumferential groove 109a of the disk part 94a, respectively.

The extended special key can be restricted to the fine-collection function (without cylinder-replacement function), if the back of the key is disengaged in the region of the interlocking of the cylinder housing in the bushing.

The variant shown in FIGS. 20a to 22a corresponds substantially to that of the first embodiment. Instead of a polygonal section 29a, the cylinder core 16a now bears at its free end a pinion 110a which has a circumferential groove 28a in front of it. When the bolt is retracted, the flank 73a of the swivel arm 66a extends into said circumferential groove and thus forms a support for the swivel arm. Furthermore, the key slot 111a extends into the pinion 110a. The latter meshes with the teeth of a toothed rack 112a of the bolt 42a, which rack flanks an opening in the bolt. The key can be removed from the lock cylinder only with the bolt advanced. During the normal locking action by means of the key, the bolt can be advanced only when the required coin 64a is inserted into the lock.

In order to be able to remove the lock cylinder with cylinder core 16a, the pinion 110a has at its end facing the circumferential groove 28a a lift bevel 113a for the swivel arm 66a. When the bolt is in retracted position and the lock cylinder with cylinder core 16a are removed, the lift bevel 113a acts on the swivel arm 66a in the region of the flank 73a and displaces it to such an extent that the pinion 110a can pass the swivel arm. The swivel arm 66a then drops back due to gravity, this swinging motion being limited by a stop pin 121a of the lock cover 11a.

The insertion of a lock cylinder also requires a control bevel 114a which is located at the front end of the pinion 110a. The bevels 113a and 114a can extend either over the entire circumference or only over the corresponding angle of rotation which permits insertion or removal of the lock cylinder.

Figure 21:
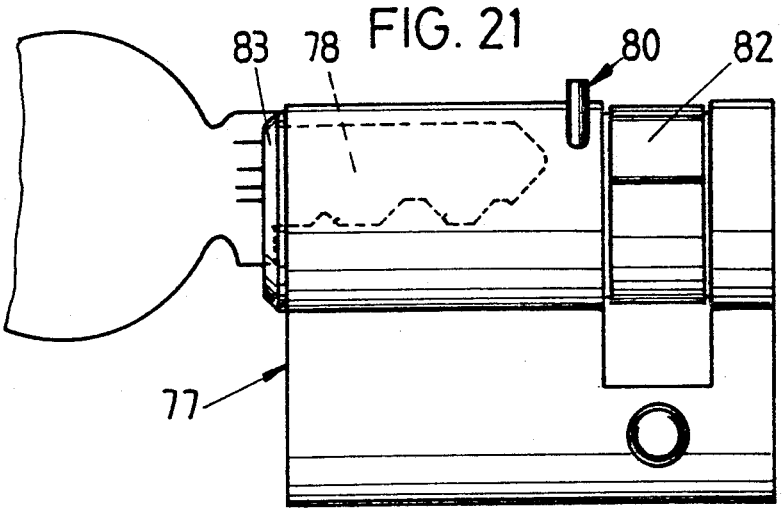
FIG. 21 is a view of the lock cylinder with the normal key inserted.
Figures 20A, 21A, 22A:
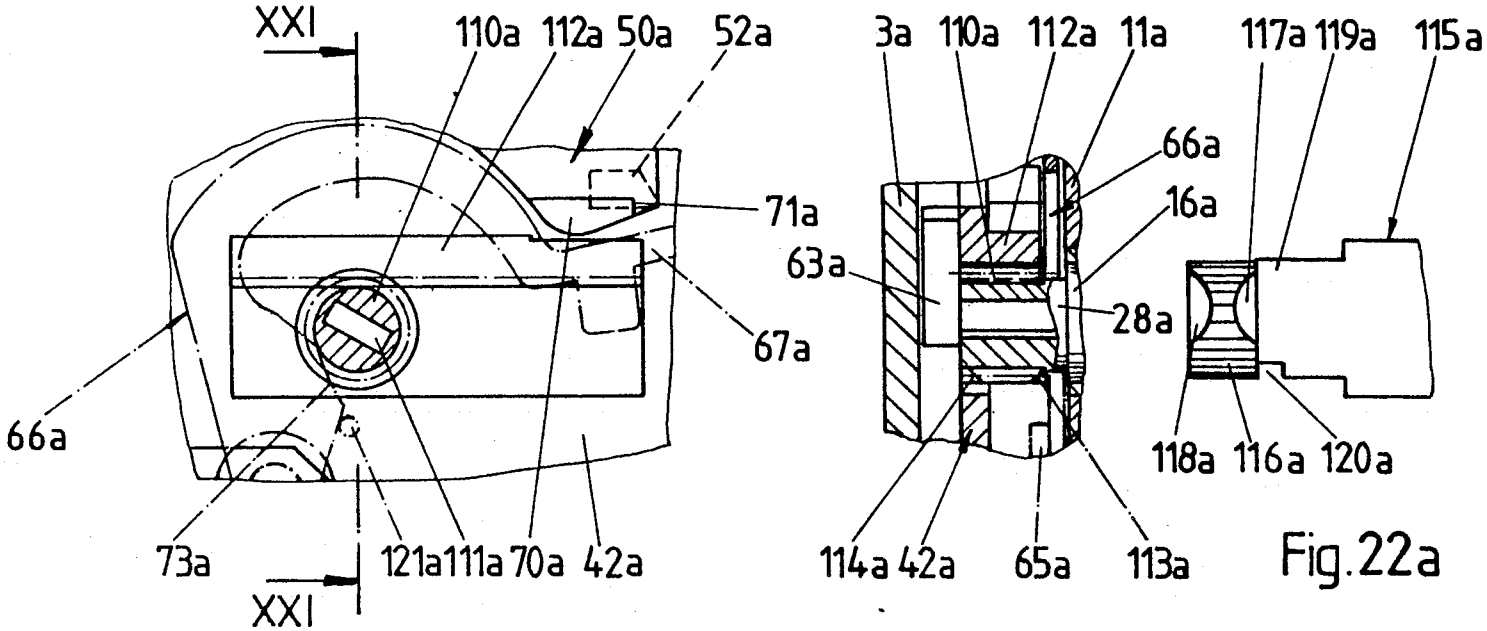
FIG. 20*a* is a front view of a section of the lock according to the third embodiment in the region of the end of the cylinder core, with the lock cover removed.
FIG. 21*a* is a section along the line XXI—XXI in FIG. 20*a*.
FIG. 22*a* is a view of the controlling region of the corresponding auxiliary key.

The auxiliary key 115a shown in FIG. 22a corresponds substantially to the auxiliary key 74a. The coupling piece is in this case a pinion 116a. In the same way as the pinion 110a of the cylinder core, the pinion 116a is provided with corresponding bevels 117a and 118a for the displacement of the swivel arm 66a upon the installation or removal of the lock cylinder. A control projection 119a, opposite which there is a recess 120a, adjoins the pinion 116a.

The auxiliary key 115a makes it possible to advance the bolt 42a without insertion of a coin. Upon the corresponding locking turn, the control projection 119a displaces the swivel arm 66a via its flank 73a. The manner of action of this auxiliary key 115a is identical to that of auxiliary key 74a. Dimensional adaptation between pinion 116a and control projection 119a has been effected in such a manner that upon removal of the auxiliary key 115a, the swivel arm 66a does not leave the lift position of the bolt keeper 50a. The new lock cylinder can then be inserted, the control bevel 114a of the cylinder core not entering into action.

I claim:

1. A locking device operative by use of a first key and a second removal key which is different from said first key, the locking device comprising a bolt lock, a bolt actuation device, and a key-actuated lock cylinder having a locking member; and wherein the lock cylinder with its locking member is in coupling engagement with said bolt-actuation device and is removable from said bolt lock only with the use of said second removal key; and said locking device includes a catch while drops upon removal of said lock cylinder and prevents re-insertion of said lock cylinder.

2. A locking device according to claim 1, further comprising a bolt actuatable by the actuation device; and wherein the removal key is rotatable through only a limited angle over which angle of rotation said locking member cannot be coupled with an opening of said bolt-actuation either in an open or in a closed position of the bolt.

3. A locking device according to claim 1, wherein said lock cylinder is secured with an interlock and a holding bushing; and said removal key releases said interlock with said holding bushing.

4. A locking device according to claim 2, further comprising a blocking finger which, as a function of said bolt movement, is swung in front of the bolt-actuation opening, blocking the latter.

5. A locking device according to claim 1, further comprising a mortise lock with a lock cover, and a passage opening arranged in the lock cover of the mortise lock; and wherein the passage opening is adapted to the locking member, there being a passage-blocking finger located for blocking said passage opening; and by use of said removal key, with which the locking member can be turned from a position corresponding to the key-insertion position into alignment with the passage opening to offset the passage-blocking finger during removal of the lock cylinder.

6. A locking device according to claim 5, wherein the passage-blocking finger is spring-loaded in the direction of a position of coincidence with the passage opening, and has run-on flanks facing a turning circle of the locking member.

7. A locking device according to claim 5, wherein the passage-blocking finger is developed as a spring.

8. A locking device according to claim 2, wherein the bolt is spring-loaded in opening direction.

9. A locking device according to claim 4, further comprising a bolt driver operatively connected to said locking member, the bolt driver having a hub with a radial slot therein; and wherein said blocking finger enters, through the radial slot in the hub of said bolt driver, into a locking-member passage cross-section of said hub.

10. A locking device according to claim 1, wherein said locking member has run-on bevels located in axial direction of a core of said lock cylinder.

11. A locking device according to claim 1 wherein said lock has a bolt; and a locking function which is released after insertion of a coin;

a lock cover which supports said lock cylinder; and wherein a core of said cylinder is coupled to said bolt to enable said bolt to be displaced upon insertion of said first key into the key slot of the cylinder core;

there is a plug connection of the lock cylinder to the lock, which connection can be separated by means of the second removal key; and the lock includes bolt operation means responsive to a third auxiliary key for enabling said bolt to be actuated by means of the auxiliary key upon removal of the lock cylinder from the lock.

12. A locking device according to claim 11, further comprising a toothed rack extending from said bolt; and wherein said cylinder core includes a pinion configured to mate with said auxiliary key, said pinion meshing with teeth of the toothed rack of the bolt.

13. A locking device according to claim 1, further comprising a driver, mounted in the lock, for coupling/plug engagement with a core of the cylinder, and providing for actuation by a third auxiliary key.

14. A locking device according to claim 13, wherein said lock includes a lock cover, and the driver comprises a disk mounted in an opening in the lock cover.

15. A locking device according to claim 14, wherein;

said disk comprises two disk parts which are plug-connected in the direction of their axes of rotation, there being a control arm extending from one of said disk parts for acting on the bolt while the other disk part has a polygonal depression for coupling engagement with the cylinder core.

16. A locking device according to claim 15, wherein said disk has an opening which extends into the inside of the lock for receiving a control projection of the auxiliary key in order to effect a locking without coin.

17. A lock according to claim 1 further comprising a cover of said lock with a support protruding from the lock cover, there being a hollow space in the support for receiving the lock cylinder.

18. A lock according to claim 17, further comprising a detent extending from said lock cylinder for securing the cylinder in said support, the detent being releasable by means of a special key to free said lock cylinder.

19. A lock according to claim 16, wherein said disk part having the depression further comprises a circumferential groove which intersects the disk opening; and the control projection of the auxiliary key engages into the circumferential groove.

20. A lock according to claim 11, further comprising a bolt, and a bolt keeper which is engageable with the bolt;

a swivel arm which, upon pivoting, deflects the bolt keeper from the bolt to enable retraction of the bolt; and wherein a control projection of the auxiliary key acts upon the swivel arm to deflect the bolt keeper from the bolt, the bolt keeper being activatable in a bolt release position by the edge of a coin presented to the lock.

21. A lock according to claim 20, wherein a maintaining of a lifted position of the bolt keeper is obtained by frictional engagement of an end of the swivel-arm against an edge of the bolt keeper.

22. A lock according to claim 21, wherein a portion of the bolt is formed as a bolt bevel; and the frictional engagement of the swivel-arm with the bolt keeper is eliminated by a raising of the bolt keeper by the bolt bevel during displacement of the bolt past the keeper upon the next advance of the bolt.

23. A lock according to claim 22, wherein the bolt keeper has a crescent shaped projection; and the frictional engagement between the swivel arm and the bolt keeper takes place on a crescent-shaped projection of the bolt keeper; and application edges of the crescent-shaped projection and of the swivel-arm end swing over intersecting arcs.

24. A lock according to claim 14, wherein the cylinder core has an extension; and the disk comprises a hub with a control arm extending from the hub, the hub having a polygonal depression for coupling with the extension of the cylinder core.

25. A lock according to claim 24, wherein the extension of the cylinder core has an opening configured as a partial annular groove extending into the lock for receiving a control projection of the auxiliary key.

26. A lock according to claim 24, wherein the hub has a bearing collar, a portion of the hub being formed as an acurate web which extends from the bearing collar to the control arm.

27. A lock according to claim 14, further comprising a support protruding from said cover, the support including a bushing providing access to the disk.

28. A lock according to claim 27, wherein the auxiliary key comprises a plate of a width which fits to the inside diameter of the bushing.

* * * * *